US012455143B2

(12) United States Patent
Yeates et al.

(10) Patent No.: US 12,455,143 B2
(45) Date of Patent: Oct. 28, 2025

(54) PLATE CARRIER

(71) Applicant: Sentry Solutions Products Group LLC, Virginia Beach, VA (US)

(72) Inventors: Eric M. Yeates, Virginia Beach, VA (US); Frederick W. Storms, Jr., Virginia Beach, VA (US)

(73) Assignee: Sentry Solutions Products Group LLC, Virginia Beach, VA (US)

( * ) Notice: Subject to any disclaimer, the term of this patent is extended or adjusted under 35 U.S.C. 154(b) by 146 days.

(21) Appl. No.: 17/604,542

(22) PCT Filed: Apr. 29, 2020

(86) PCT No.: PCT/US2020/030561
§ 371 (c)(1),
(2) Date: Oct. 18, 2021

(87) PCT Pub. No.: WO2020/223412
PCT Pub. Date: Nov. 5, 2020

(65) Prior Publication Data

US 2022/0196367 A1 Jun. 23, 2022

Related U.S. Application Data

(60) Provisional application No. 62/841,219, filed on Apr. 30, 2019.

(51) Int. Cl.
*F41H 1/02* (2006.01)
*A41D 13/05* (2006.01)

(52) U.S. Cl.
CPC ..... *F41H 1/02* (2013.01); *A41D 13/05* (2013.01)

(58) Field of Classification Search
CPC ..... F41H 1/02; A41D 13/0012; A41D 13/05; A41D 13/0518; A41D 13/055;
(Continued)

(56) References Cited

U.S. PATENT DOCUMENTS 7,987,523 B2 8/2011 Cole et al.
8,572,762 B2 11/2013 Herbener et al.
(Continued)

FOREIGN PATENT DOCUMENTS

JP 2007333315 A * 12/2007

OTHER PUBLICATIONS

Machine translation of JP-2007333315-A (Japanese to English). Accessed from Espacenet on Sep. 29, 2023. (Year: 2023).*
(Continued)

*Primary Examiner* — Patrick J. Lynch
*Assistant Examiner* — Brianna T. Duckworth
(74) *Attorney, Agent, or Firm* — Shaddock Law Group, PC

(57) ABSTRACT

A plate carrier having at least some of a front carrier having front shoulder strap extensions formed integral to the front carrier, wherein the front shoulder strap extensions extend from a portion of the front carrier; and a back carrier having back shoulder strap extensions formed integral to the back carrier, wherein the back shoulder strap extensions extend from a portion of the back carrier, and wherein each of the back shoulder strap extensions includes a shoulder strap channel formed through at least a portion of the back shoulder strap extension such that at least a portion of one of the front shoulder strap extension may be received within at least a portion of each respective shoulder strap channel.

20 Claims, 18 Drawing Sheets

(58) Field of Classification Search
CPC ..... A41D 13/0556; A41D 13/0562; A41D 13/0568; A41D 13/0575
See application file for complete search history.

(56) References Cited

U.S. PATENT DOCUMENTS

| | | | | |
|---|---|---|---|---|
| 2005/0005342 | A1* | 1/2005 | Johnson | F41H 1/02 2/102 |
| 2012/0084906 | A1* | 4/2012 | Sego, Jr. | F41H 1/02 2/463 |
| 2012/0167267 | A1 | 7/2012 | Osman | |
| 2015/0153140 | A1* | 6/2015 | Crye | A41F 1/00 2/102 |
| 2019/0000221 | A1* | 1/2019 | Yeates | A45F 5/02 |
| 2020/0003526 | A1* | 1/2020 | LeMarbe | F41H 5/02 |

OTHER PUBLICATIONS

Definition of "integral" from Dictionary.com. Accessed from https://www.dictionary.com/browse/integral on May 3, 2024. (Year: 2024).*

* cited by examiner

PLATE CARRIER

CROSS-REFERENCE TO RELATED APPLICATIONS

This patent application claims the benefit of U.S. Patent Application Ser. No. 62/841,219, filed Apr. 30, 2019, the disclosure of which is incorporated herein in its entirety by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE PRESENT DISCLOSURE

1. Field of the Present Disclosure

The present disclosure relates generally to vests or carriers. In particular, the present disclosure relates to an improved plate carrier.

2. Description of Related Art

It is advantageous be able to configure and/or reconfigure various pouches, pockets, holsters, holders, and other accessories on items such as, for example, articles of clothing, vests, plate carriers, backpacks, packs, platforms, and other carriers.

It is generally known to removably attach such items using a MOLLE or other similar attachment system. The term MOLLE (Modular Lightweight Load-carrying Equipment) is used to generically describe load bearing systems and subsystems that utilize corresponding rows of woven webbing for modular pouch, pocket, and accessory attachment.

Military and law enforcement personnel, particularly those attached to special operations unit, utilize plate carriers to carry ballistic panels or body armor.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

SUMMARY OF THE PRESENT DISCLOSURE

However, current plate carriers are typically bulky and include a multitude of separate components or panels. Furthermore, current plate carriers are typically limited in the manner and orientation that accessories can be attached or coupled to the plate carriers.

Additionally, current vests and plate carriers include shoulder straps that are linear and do not naturally follow the contour of a wearer's shoulders.

Therefore, the present disclosure relates generally to plate carriers with improved ergonomics and contours allow the plate carriers of the present disclosure to be more formfitting and comfortable for a user to wear.

In various exemplary, non-limiting embodiments, the plate carrier comprises at least some of a front carrier, a back carrier, and at least one cummerbund element extending from or coupled between the front carrier and/or the back carrier.

In various exemplary, non-limiting embodiments, the plate carrier comprises at least some of a front carrier having front shoulder strap extensions formed integral to the front carrier, wherein the front shoulder strap extensions extend from a portion of the front carrier; and a back carrier having back shoulder strap extensions formed integral to the back carrier, wherein the back shoulder strap extensions extend from a portion of the back carrier, and wherein each of the back shoulder strap extensions includes a shoulder strap channel formed through at least a portion of the back shoulder strap extension such that at least a portion of one of the front shoulder strap extension may be received within at least a portion of each respective shoulder strap channel.

In various exemplary, non-limiting embodiments, at least one cummerbund element releasably attaches or couples the front carrier to the back carrier.

In various exemplary, non-limiting embodiments, two front shoulder strap carrier slots are formed in a portion of the back carrier, wherein each front shoulder strap carrier slot provides access to a back carrier plate cavity, and wherein at least a portion of a terminating and of the front shoulder strap extension is positionable through the front shoulder strap carrier slot.

In various exemplary, non-limiting embodiments, each of the front shoulder strap extensions includes a front shoulder strap releasable fastener element and wherein at least a portion of a back shoulder strap releasable fastener element is attached or coupled within the shoulder strap channel to releasably interact with the front shoulder strap releasable fastener element if one of the front shoulder strap extensions is appropriately positioned within the shoulder strap channel.

In various exemplary, non-limiting embodiments, a plurality of attachment apertures are formed through at least a portion of the front carrier. In various exemplary, non-limiting embodiments, each attachment aperture is defined by two substantially equal length, substantially parallel sides, an arcuate side joining respective upper terminal ends of the substantially parallel sides, and an arcuate side joining respective lower terminal ends of the substantially parallel sides. In various exemplary, non-limiting embodiments, the front carrier includes a front attachment layer, wherein a plurality of attachment apertures are formed through at least a portion of the front attachment layer. In various exemplary, non-limiting embodiments, an aperture array is formed in the front attachment layer, wherein the aperture array includes a plurality of attachment apertures arranged in a repeating sequence of spaced rows and spaced columns.

In various exemplary, non-limiting embodiments, a plurality of attachment apertures are formed through at least a portion of the back carrier. In various exemplary, non-limiting embodiments, each attachment aperture is defined by two substantially equal length, substantially parallel sides, an arcuate side joining respective upper terminal ends of the substantially parallel sides, and an arcuate side joining respective lower terminal ends of the substantially parallel sides. In various exemplary, non-limiting embodiments, the back carrier includes a back attachment layer, wherein a plurality of attachment apertures are formed through at least a portion of the back attachment layer. In various exemplary, non-limiting embodiments, an aperture array is formed in the back attachment layer, wherein the aperture array includes a plurality of attachment apertures arranged in a repeating sequence of spaced rows and spaced columns.

In various exemplary, non-limiting embodiments, the plate carrier comprises at least some of a front carrier having a front attachment layer, wherein front shoulder strap extensions are formed integral to the front attachment layer, and wherein the front shoulder strap extensions extend from a portion of the front attachment layer; and a back carrier having a back attachment layer, wherein back shoulder strap extensions are formed integral to the back attachment layer, wherein the back shoulder strap extensions extend from a portion of the back attachment layer, and wherein each of the back shoulder strap extensions includes a shoulder strap channel formed through at least a portion of the back shoulder strap extension such that at least a portion of one of the front shoulder strap extensions may be received within at least a portion of each respective shoulder strap channel.

In various exemplary, non-limiting embodiments, at least one cummerbund element releasably attaches or couples the front carrier to the back carrier.

In various exemplary, non-limiting embodiments, each of the front shoulder strap extensions includes a front shoulder strap releasable fastener element and wherein at least a portion of a back shoulder strap releasable fastener element is attached or coupled within the shoulder strap channel to releasably interact with the front shoulder strap releasable fastener element if one of the front shoulder strap extensions is appropriately positioned within the shoulder strap channel.

In various exemplary, non-limiting embodiments, a plurality of attachment apertures are formed through at least a portion of the front attachment layer. In various exemplary, non-limiting embodiments, each attachment aperture is defined by two substantially equal length, substantially parallel sides, an arcuate side joining respective upper terminal ends of the substantially parallel sides, and an arcuate side joining respective lower terminal ends of the substantially parallel sides.

In various exemplary, non-limiting embodiments, a plurality of attachment apertures are formed through at least a portion of the back attachment layer. In various exemplary, non-limiting embodiments, each attachment aperture is defined by two substantially equal length, substantially parallel sides, an arcuate side joining respective upper terminal ends of the substantially parallel sides, and an arcuate side joining respective lower terminal ends of the substantially parallel sides.

In various exemplary, non-limiting embodiments, the plate carrier comprises at least some of a front carrier having a front attachment layer, wherein front shoulder strap extensions are formed integral to the front attachment layer, wherein the front shoulder strap extensions extend from a portion of the front attachment layer, wherein a plurality of attachment apertures are formed through at least a portion of the front carrier; and a back carrier having a back attachment layer, wherein back shoulder strap extensions are formed integral to the back attachment layer, wherein the back shoulder strap extensions extend from a portion of the back attachment layer, wherein each of the back shoulder strap extensions includes a shoulder strap channel formed through at least a portion of the back shoulder strap extension such that at least a portion of one of the front shoulder strap extensions may be received within at least a portion of each respective shoulder strap channel, wherein a plurality of attachment apertures are formed through at least a portion of the back carrier, and wherein each attachment aperture is defined by two substantially equal length, substantially parallel sides, an arcuate side joining respective upper terminal ends of the substantially parallel sides, and an arcuate side joining respective lower terminal ends of the substantially parallel sides.

Accordingly, the present disclosure provides a plate carrier of improved design.

The present disclosure separately provides a plate carrier, which is capable of providing an increased level of fitment to a user.

The present disclosure separately provides a plate carrier, which is capable of allowing accessories to be attached to portions of the plate carrier at desired orientations.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures.

While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the systems, methods, devices, and/or apparatuses discussed herein. In similar fashion, while exemplary embodiments may be discussed below as system, method, device, and/or apparatus embodiments, it is to be understood that such exemplary embodiments can be implemented in various systems, methods, devices, and/or apparatuses of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE DRAWINGS

As required, detailed exemplary embodiments of the present disclosure are disclosed herein; however, it is to be understood that the disclosed embodiments are merely exemplary of the present disclosure that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the present disclosure will be described in detail, with reference to the following figures, wherein like reference numerals refer to like parts throughout the several views, and wherein.

DETAILED DESCRIPTION OF EXEMPLARY EMBODIMENTS OF THE PRESENT DISCLOSURE

Figure 1:
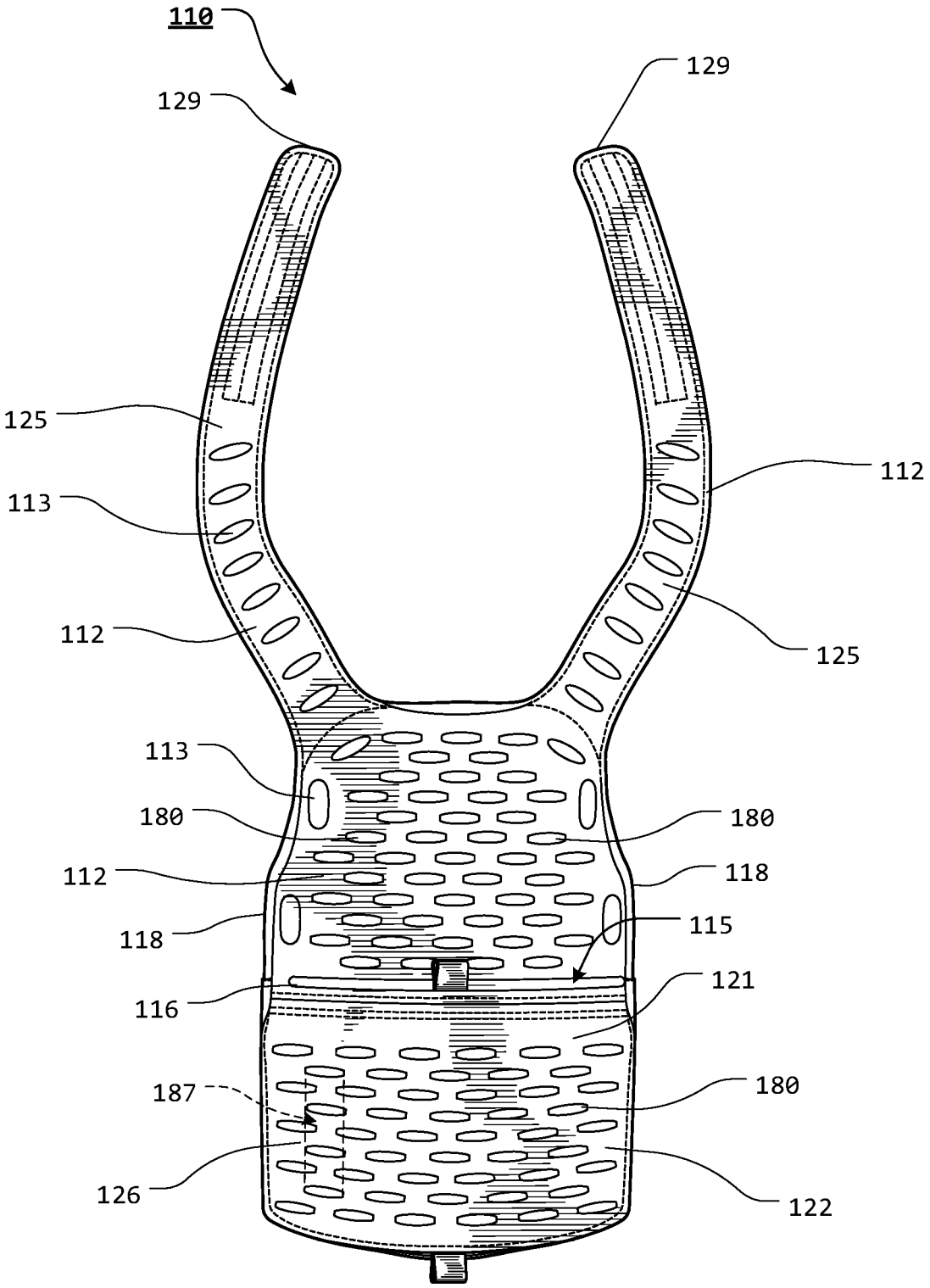
FIG. 1 shows a front view of an exemplary embodiment of a front carrier of a plate carrier, according to an exemplary embodiment of the present disclosure.

For simplicity and clarification, the design factors and operating principles of the plate carrier of the present disclosure are explained with reference to various exemplary embodiments of a plate carrier. The basic explanation of the design factors and operating principles of the plate carrier is applicable for the understanding, design, and operation of the plate carrier of the present disclosure. It should be appreciated that the plate carrier can be adapted to many applications where a plate carrier, carrier, or vest can be used.

As used herein, the word "may" is meant to convey a permissive sense (i.e., meaning "having the potential to"), rather than a mandatory sense (i.e., meaning "must"). Unless stated otherwise, terms such as "first" and "second", "right" and "left", "front" and "rear", "top" and "bottom", "upper" and "lower", and "horizontal" and "vertical" are used as a naming convention to arbitrarily distinguish between the exemplary embodiments and/or elements such terms describe. Thus, these terms are not necessarily intended to indicate temporal or other prioritization of such exemplary embodiments and/or elements, but are used to help differentiate between certain of the components of the present disclosure and are not to be construed as limiting the present disclosure.

As used herein, and unless the context dictates otherwise, the term "coupled" is intended to include both direct coupling (in which two elements that are coupled to each other contact each other) and indirect coupling (in which at least one additional element is located between the two elements). The term coupled, as used herein, is defined as connected, although not necessarily directly, and not necessarily mechanically. The terms "a" and "an" are defined as one or more unless stated otherwise.

The terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, device, and/or apparatus that "comprises", "has", "includes", or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

It should also be appreciated that, for simplicity and clarification, the embodiments of the present disclosure will be described using the terms "front" and "back". However, it should be understood that these terms are merely used to aid in understanding of the present disclosure are not to be construed as limiting the systems, methods, devices, and/or apparatuses of the present disclosure. Thus, it should be appreciated that the design factors and operating principles of the plate carrier described herein may be used in a "mirror image" plate carrier, where in the elements described as being included in or on the front carrier are included in or on the rear or back carrier. Alternatively, certain of the elements that are described as being included in or on the back of the plate carrier may be included in or on the front of the plate carrier, or vice versa.

Furthermore, it should be appreciated that, for simplicity and clarification, the embodiments of the present disclosure will be shown and/or described with reference to one or more attachment arrays being included on various portions of the plate carrier. However, it should be appreciated that the inclusion and/or placement of any passion array is not essential to the plate carrier of the present disclosure. In various exemplary, non-limiting embodiments of the present disclosure, the plate carrier may incorporate any type of known or later developed system capable of allowing any number of exterior pouches, pockets, carriers, or the like to be permanently or releasably coupled or attached to the plate carrier. Alternatively, the design factors and principles of the present disclosure may be utilized in a plate carrier that does not include any attachment array, exterior pouches, pockets, or carriers, but is used as, for example, a ballistic plate carrier or a floatation device.

It should also be appreciated that the terms "plate carrier", "shoulder strap", "cummerbund", and "side plate" are used for basic explanation and understanding of the operation of the systems, methods, devices, and/or apparatuses of the present disclosure. Therefore, the terms "plate carrier", "shoulder strap", "cummerbund", and "side plate" are not to be construed as limiting the systems, methods, devices, apparatuses, and/or applications of the present disclosure.

Turning now to the drawing figures, FIGS. 1 through 37 show various features of an exemplary embodiment of a plate carrier 100, according to an exemplary embodiment of the present disclosure. As illustrated in the drawing figures, the plate carrier 100 includes at least some of a front carrier 110 having front shoulder strap extensions 125 extending therefrom, a back carrier 130 having back shoulder strap extensions 145 extending therefrom, and at least one cummerbund element 150.

Figure 2:
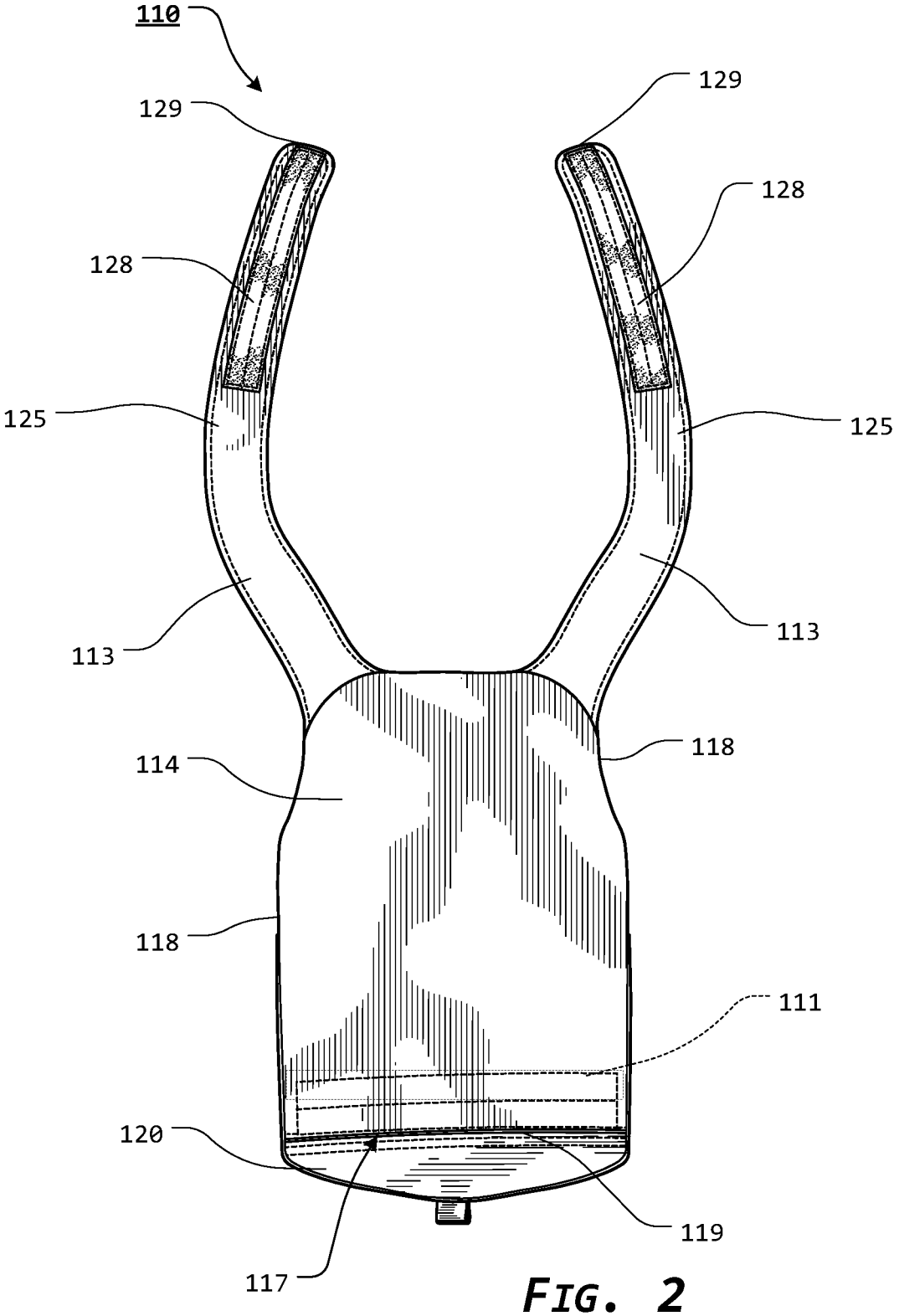
FIG. 2 shows a rear view of an exemplary embodiment of a front carrier of a plate carrier, according to an exemplary embodiment of the present disclosure.

As illustrated most clearly in FIGS. 1-2, the front carrier 110 comprises at least some of a front attachment layer 112, an outer front panel 113, and an inner front panel 114. The front attachment layer 112 is attached or coupled atop the outer front panel 113 and is secured proximate a joint perimeter of the front attachment layer 112 and the outer front panel 113.

In various exemplary embodiments, as illustrated herein, a carrier pocket 115 is formed between a lower portion of the outer front panel 113 and the front attachment layer 112. A carrier pocket opening 116 is provided to allow access to at least a portion of the carrier pocket 115.

The inner front panel 114 is attached or coupled to at least a portion of the outer front panel 113 such that an inner front carrier plate cavity 117 is formed between the outer front panel 113 and the inner front panel 114.

In various exemplary embodiments, the inner front panel 114 may be attached or coupled to the front attachment layer 112 and the outer front panel 113 by a front panel gusset 118. While the inner front panel 114 may be attached or coupled to the front attachment layer 112 and the outer front panel 113, by including a front panel gusset 118 between the inner front panel 114, the front attachment layer 112, and outer front panel 113, added strength or expansion may optionally be provided by the front panel gusset 118 and the front panel gusset 118 may optionally provide a side wall of the inner front carrier plate cavity 117 that more accurately mimics the side profile of a ballistic or other plate that is to be inserted within the inner front carrier plate cavity 117. Furthermore, the inclusion of the front panel gusset 118 may optionally also provide a more wear resistant edge or side portion to the exterior area surrounding the edge or side portion of the inner front carrier plate cavity 117.

In various exemplary, nonlimiting embodiments, the front panel gusset 118 comprises a substantially rectangular portion of material that extends around the outer perimeter of the inner front panel 114.

In various exemplary embodiments, an inner front panel flap 120 extends from a bottom portion of the outer front panel 113 to wraparound and be attached or coupled to a bottom portion of the inner front panel 114. The inner front panel flap 120 may be an integral extension of the outer front panel 113 or may comprise a separate portion of material that is attached or coupled to a bottom portion of the outer front panel 113.

A front carrier plate cavity opening 119 is provided proximate a bottom or open edge of the inner front panel 114, between a terminal or overlapping and portion of the inner front panel 114 and the inner front panel flap 120.

In various exemplary embodiments, a front carrier plate cavity releasable fastener element 111, such as, for example, corresponding portions of a hook and loop fastener or VELCRO® is provided proximate the front carrier plate cavity opening 119 (on an exterior surface of the inner front panel flap 120 and an interior surface of the inner front panel 114) to allow for closure of the front carrier plate cavity opening 119.

It should be appreciated that, in various exemplary embodiments the front carrier plate cavity releasable fastener element 111 may comprise other releasable devices or releasable fasteners, such as, for example, male/female snap-release buckles, a ZIPLOC® fastening device, a zipper, buttons, snaps, or other fastening, closure, or attachment devices known by those skilled in the art.

The front carrier plate cavity opening 119 is formed so as to allow a ballistic plate or other panel or plate to be inserted through the front carrier plate cavity opening 119 and into the inner front carrier plate cavity 117. Once properly inserted, the front carrier plate cavity releasable fastener element 111 may optionally be utilized to maintain the front carrier plate cavity opening 119 in an engaged or closed position.

The front panel flap 121 is attached or coupled, at an upper portion of the front panel flap 121, to the front attachment layer 112. The front panel flap 121 then extends downward, so as to be secured or releasably coupled to the front attachment layer 112 by mating portions of a front panel flap releasable fastener portion 123. In various exemplary embodiments, the front panel flap releasable fastener portion 123 may comprise a hook and loop fastener, such as VELCRO®. It should be appreciated that, in various exemplary embodiments the front panel flap releasable fastener portion 123 may comprise other releasable coupler or releasable fasteners, such as, for example, male/female snap-release buckles, a ZIPLOC® fastening device, a zipper, buttons, snaps, or other fastening, closure, or attachment device known by those skilled in the art.

An inner surface of the front panel flap 121 (i.e., the inner surface of the front panel flap front panel 126) includes a front panel flap releasable fastener portion 123 and the outer surface of the front attachment layer 112 also includes a mating front panel flap releasable fastener portion 123.

In various exemplary embodiments, front panel flap 121 comprises a front panel flap front panel 126 having a front panel flap attachment layer 122 attached or coupled atop the front panel flap front panel 126. One or more attachment apertures 180 are formed through the front panel flap attachment layer 122.

The area under the front panel flap 121 may include one or more front carrier attachment loops 124 attached or coupled between the front panel flap 121 and the front attachment layer 112. In various exemplary embodiments, the front carrier attachment loops 124 are formed so as allow attachment elements 175, such as, for example, flat G-Hooks to engage each attachment loop 124.

As illustrated, for example, in FIGS. 28-33, a groin protector 170 may be attached or coupled, via attachment webbing 174 and the attachment elements 175, underneath at least a portion of the front panel flap 121. The groin protector 170 also includes groin protector releasable fastener portions 172 on a front and rear surface of the groin protector 170. In this manner, the groin protector 170 may optionally engage the front panel flap releasable fastener portions 123 of the front attachment layer 112 and the front panel flap 121, such that the groin protector 170 may optionally be maintained in a retracted position, as illustrated, for example, in FIG. 32. When desired, the attachment webbing 174 may optionally be extended from the attachment elements 175 and appropriately positioned, such that the groin protector 170 may optionally be moved to an extended position, as illustrated, for example, in FIG. 33.

The front carrier 110 includes two, integral informed, front shoulder strap extensions 125 that extend from an upper portion of the front carrier 110 to front shoulder strap terminating ends 129 of the front shoulder strap extensions 125. In various exemplary embodiments, the front shoulder strap extensions 125 are formed as an integral extension of the outer front panel 113 and the front attachment layer 112. Alternatively, the front shoulder strap extensions 125 may be an integral extension of the outer front panel 113 or the front attachment layer 112.

A front shoulder strap releasable fastener element 128 is included along at least a portion of each front shoulder strap extension 125. In various exemplary embodiments, the front shoulder strap releasable fastener element 128 comprises the VELCRO® or directional VELCRO®.

Figure 3:
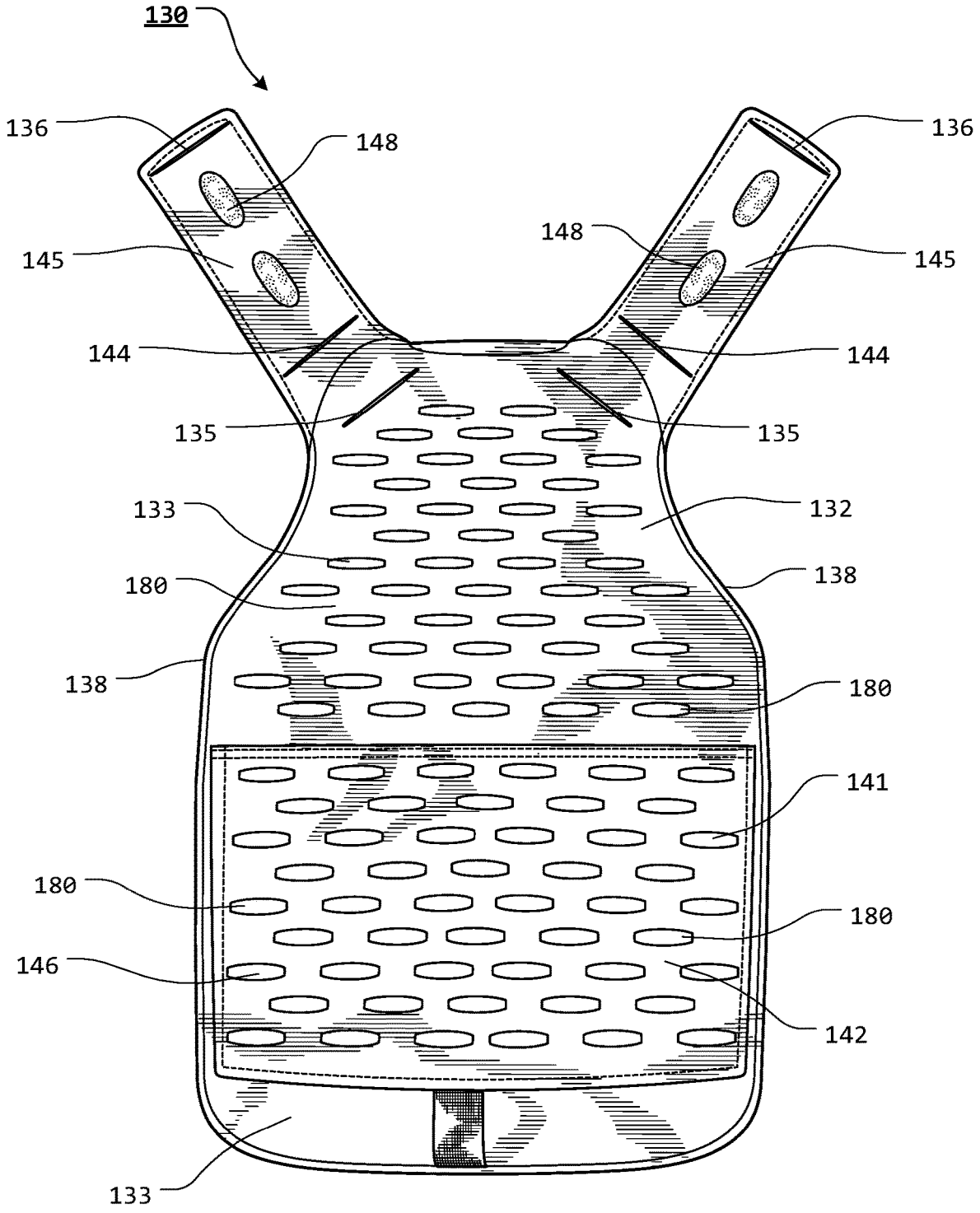
FIG. 3 shows a front view of an exemplary embodiment of a back carrier of a plate carrier, according to an exemplary embodiment of the present disclosure.
Figure 4:
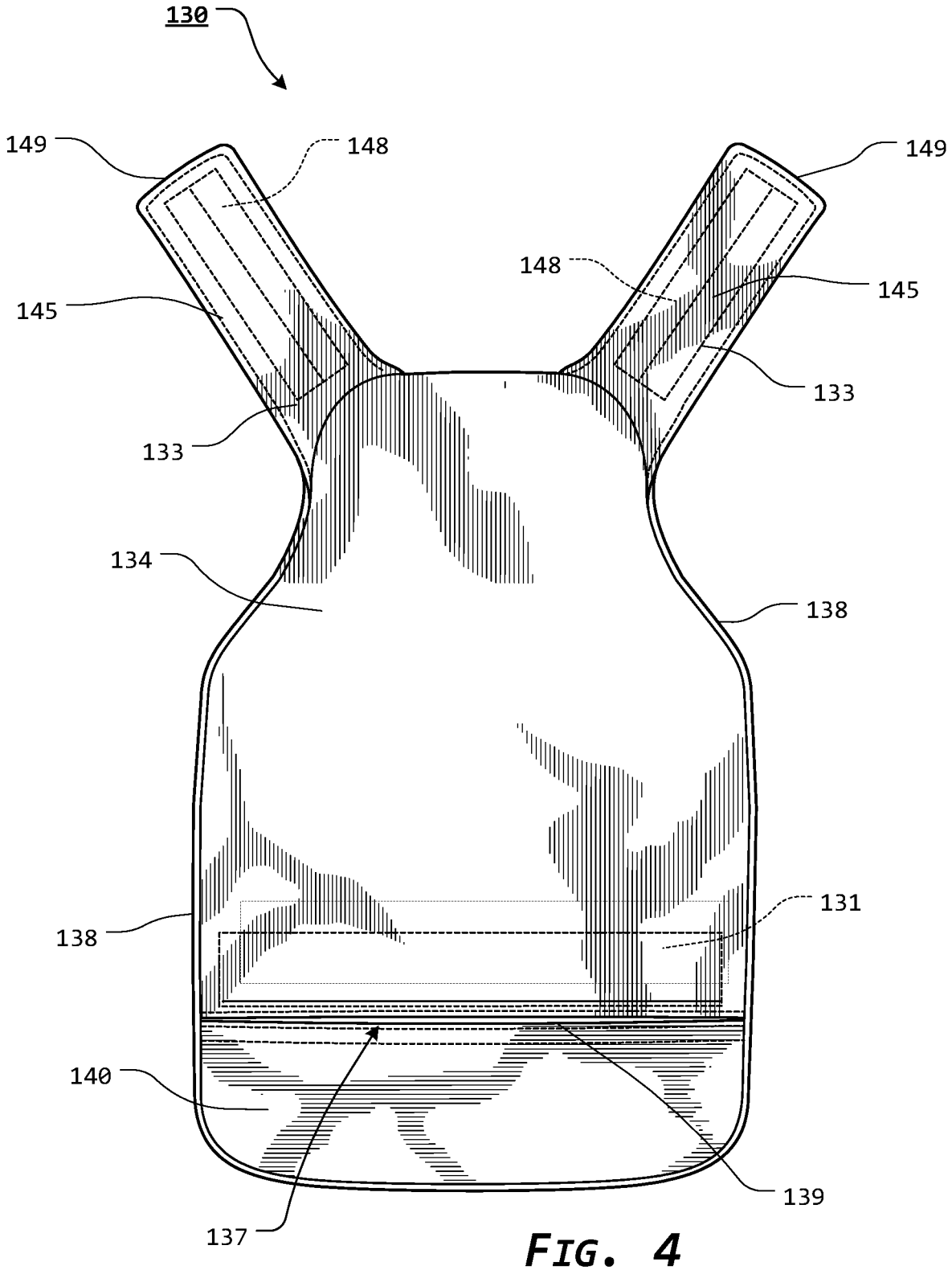
FIG. 4 shows a rear view of an exemplary embodiment of a back carrier of a plate carrier, according to an exemplary embodiment of the present disclosure.
Figure 5:
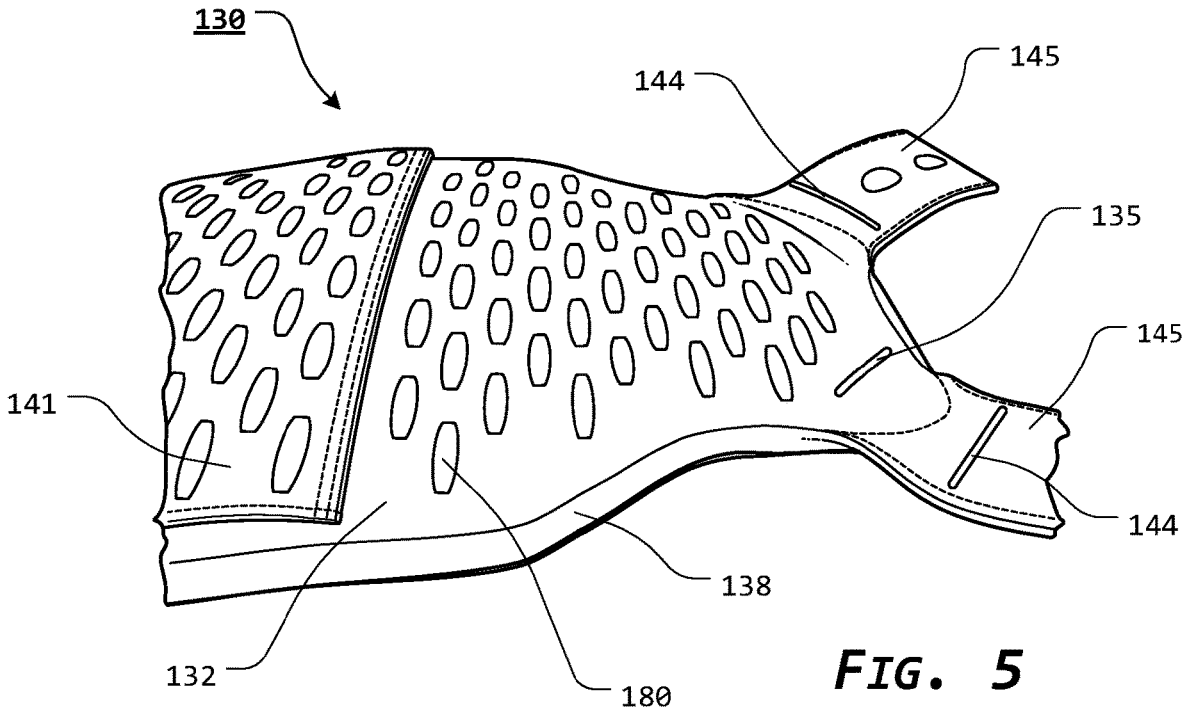
FIG. 5 shows a partial front perspective view of an exemplary embodiment of a back carrier of a plate carrier, according to an exemplary embodiment of the present disclosure.
Figure 6:
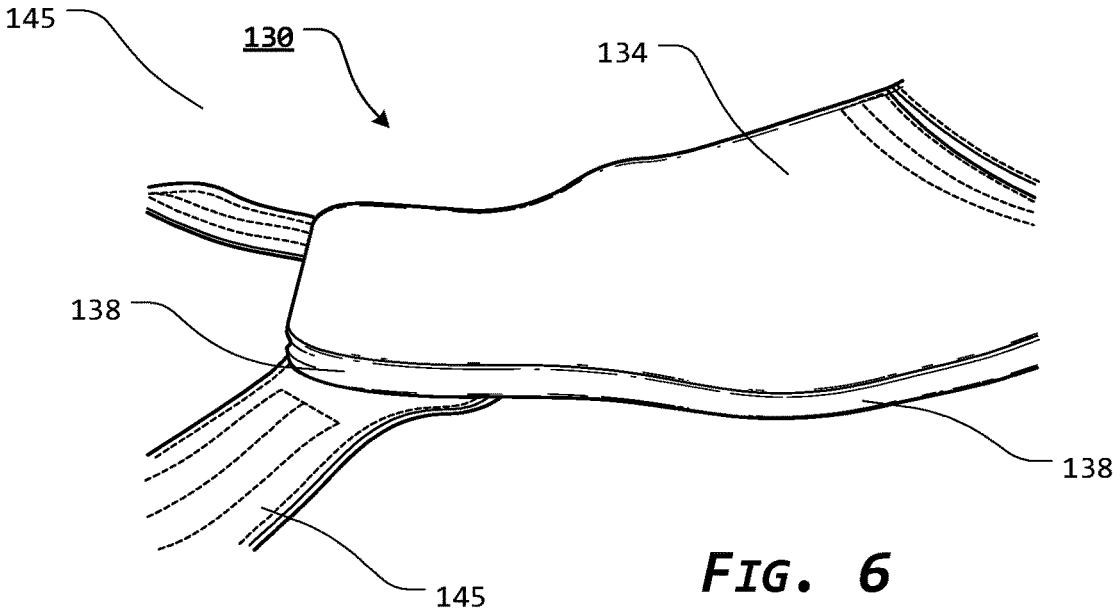
FIG. 6 shows a partial rear perspective view of an exemplary embodiment of a back carrier of a plate carrier, according to an exemplary embodiment of the present disclosure.
Figure 7:
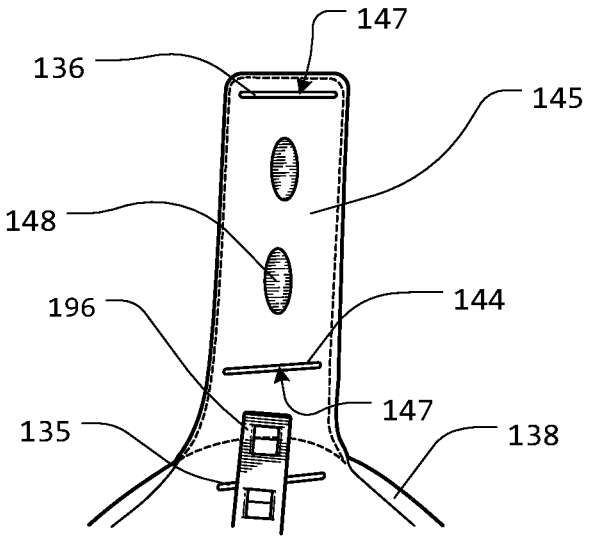
FIG. 7 shows a more detailed view of an exemplary embodiment of a back shoulder strap extension of a back carrier of a plate carrier, according to an exemplary embodiment of the present disclosure.
Figure 8:
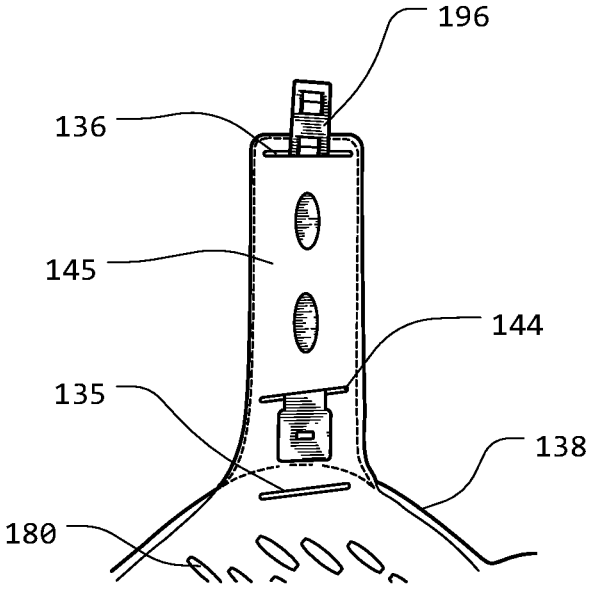
FIG. 8 shows a more detailed view of an exemplary embodiment of a back shoulder strap extension of a back carrier of a plate carrier, according to an exemplary embodiment of the present disclosure.
Figure 9:
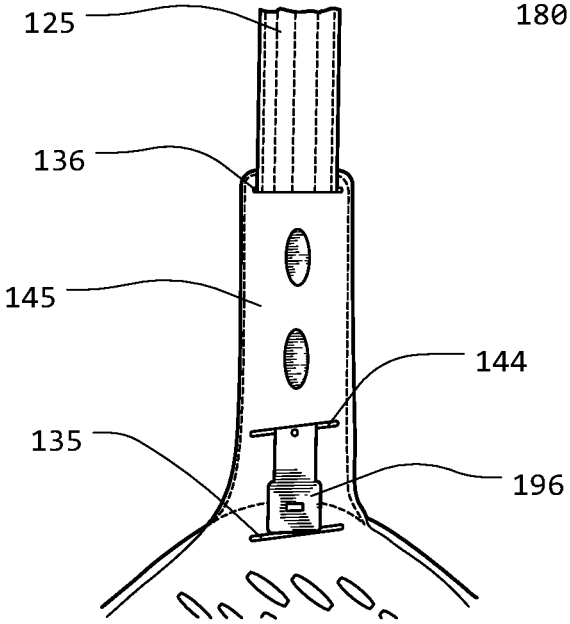
FIG. 9 shows a more detailed view of an exemplary embodiment of a back shoulder strap extension of a back carrier of a plate carrier, according to an exemplary embodiment of the present disclosure.
Figure 10:
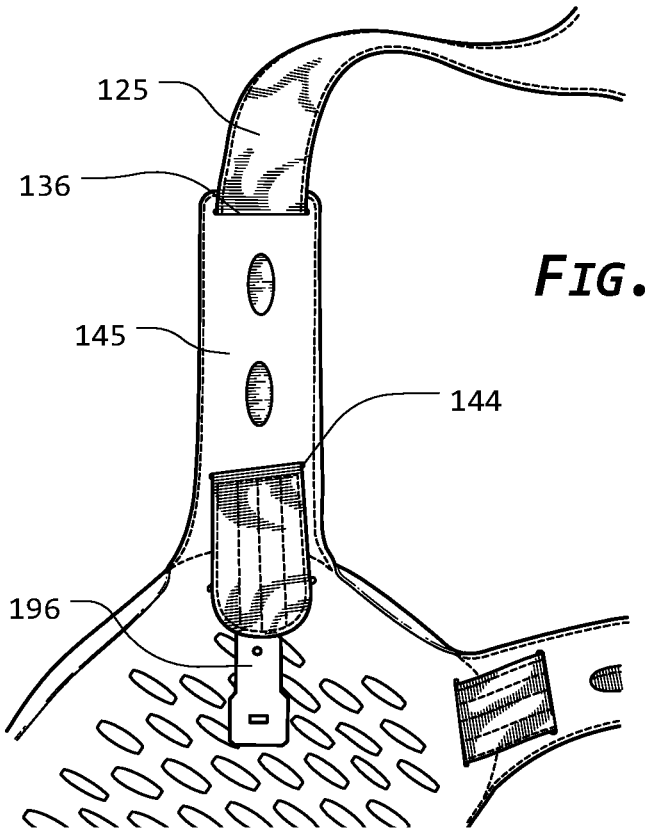
FIG. 10 shows a more detailed view of an exemplary embodiment of a back shoulder strap extension of a back carrier and a front shoulder strap extension of a front carrier of a plate carrier, according to an exemplary embodiment of the present disclosure.
Figure 11:
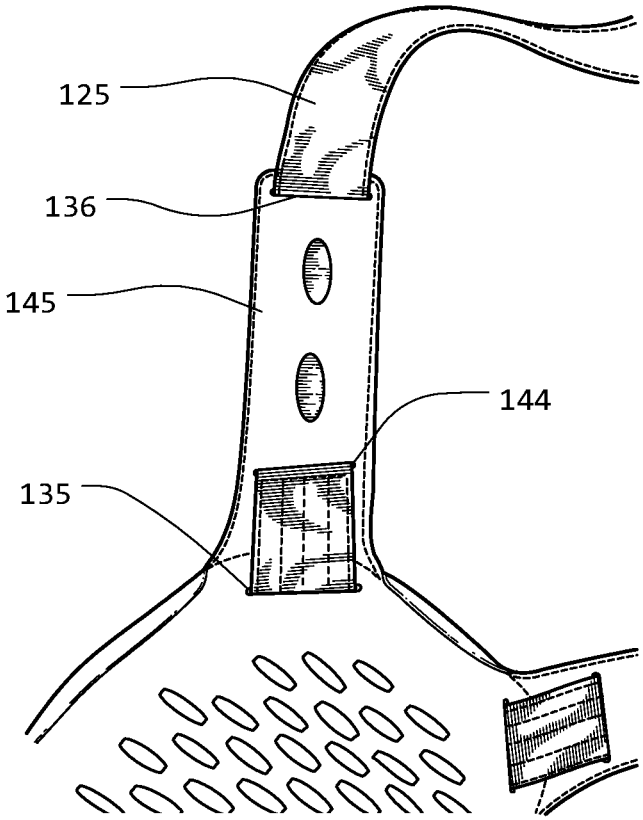
FIG. 11 shows a more detailed view of an exemplary embodiment of a back shoulder strap extension of a back carrier and a front shoulder strap extension of a front carrier of a plate carrier, according to an exemplary embodiment of the present disclosure.
Figure 12:
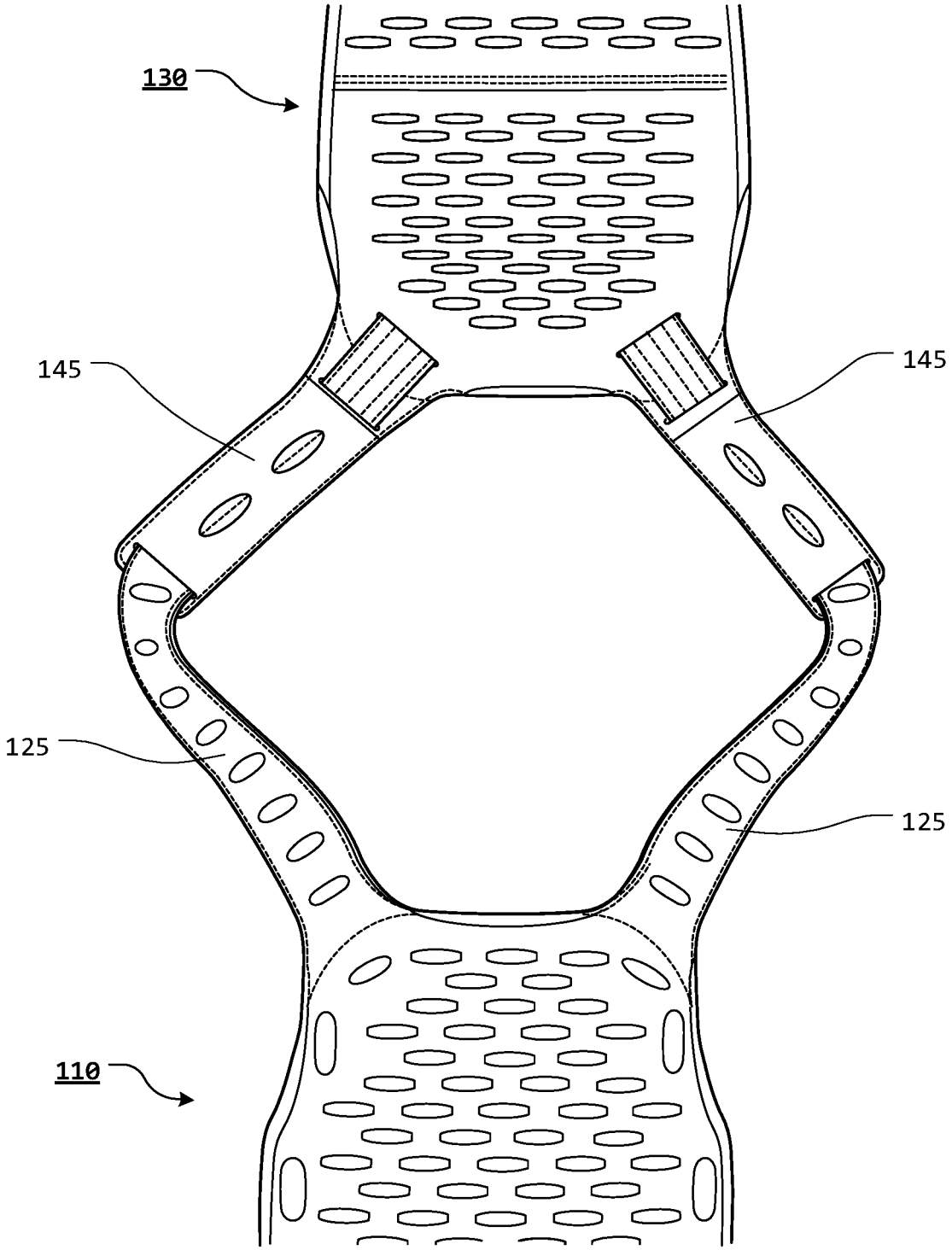
FIG. 12 shows a more detailed view of an exemplary embodiment of the back shoulder strap extensions of a back carrier and the front shoulder strap extensions of a front carrier of a plate carrier, according to an exemplary embodiment of the present disclosure.
Figure 13:
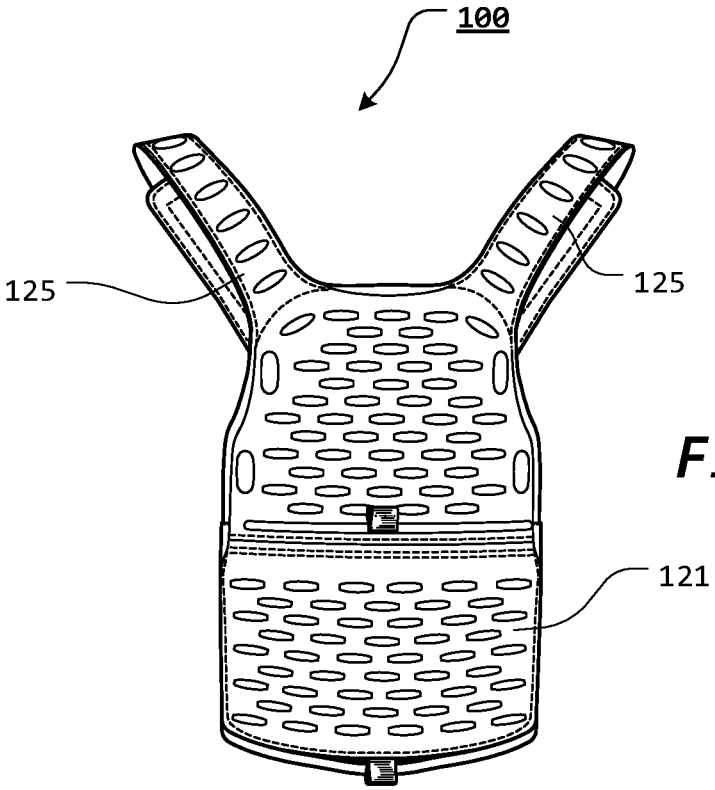
FIG. 13 shows a front view of an exemplary embodiment of the assembled back carrier and the front carrier of a plate carrier, according to an exemplary embodiment of the present disclosure.
Figure 14:
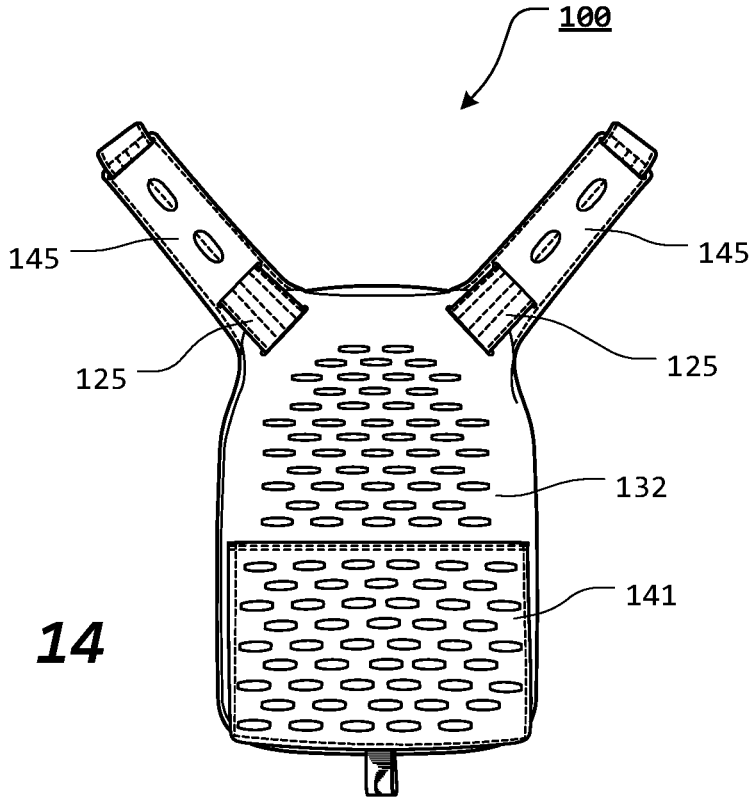
FIG. 14 shows a rear view of an exemplary embodiment of the assembled back carrier and the front carrier of a plate carrier, according to an exemplary embodiment of the present disclosure.
Figure 15:
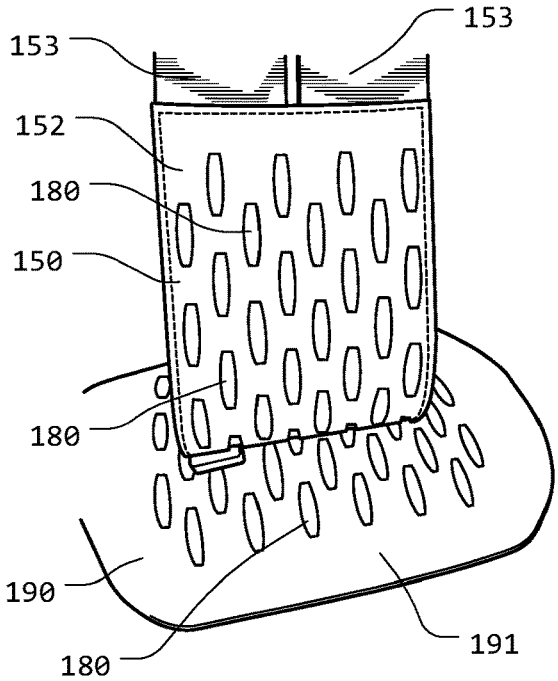
FIG. 15 shows a more detailed view of an exemplary embodiment of a side plate carrier being attached or coupled to a cummerbund element, according to an exemplary embodiment of the present disclosure.
Figure 16:
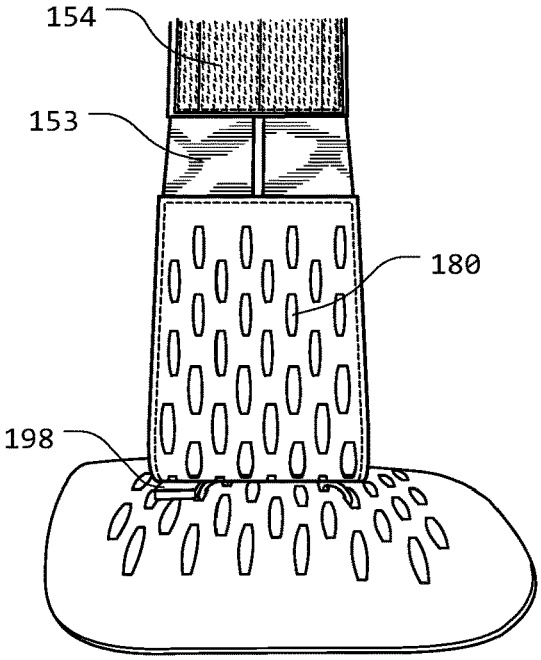
FIG. 16 shows a more detailed view of an exemplary embodiment of a side plate carrier being attached or to a cummerbund element, according to an exemplary embodiment of the present disclosure.
Figure 17:
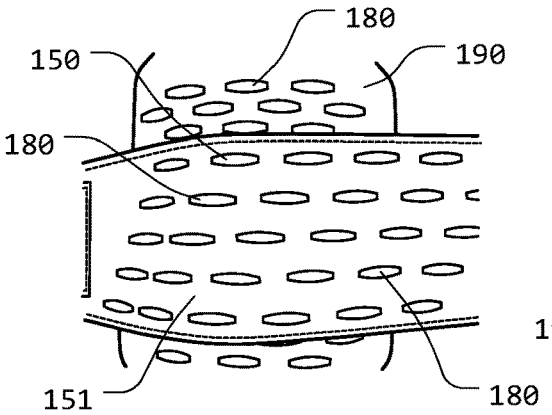
FIG. 17 shows a more detailed view of an exemplary embodiment of a side plate carrier attached or coupled to a cummerbund element, according to an exemplary embodiment of the present disclosure.
Figure 18:
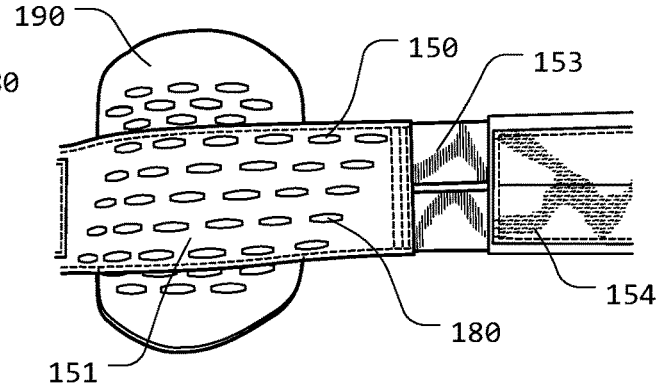
FIG. 18 shows a more detailed view of an exemplary embodiment of a side plate carrier attached or coupled to a cummerbund element, according to an exemplary embodiment of the present disclosure.
Figure 19:
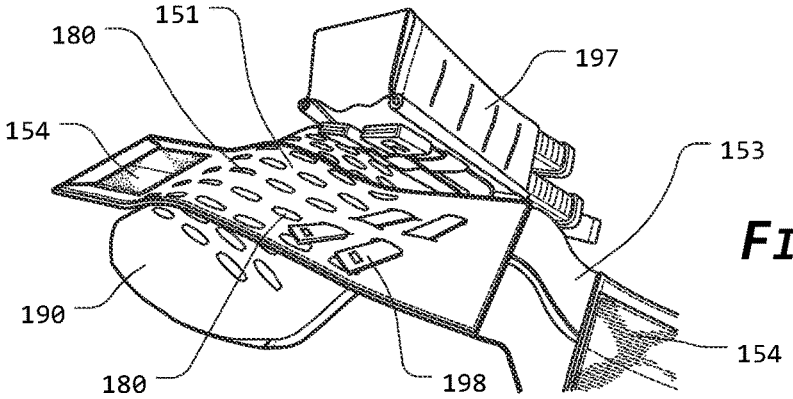
FIG. 19 shows a more detailed view of an exemplary embodiment of an accessory being attached or coupled to a cummerbund element, according to an exemplary embodiment of the present disclosure.
Figure 20:
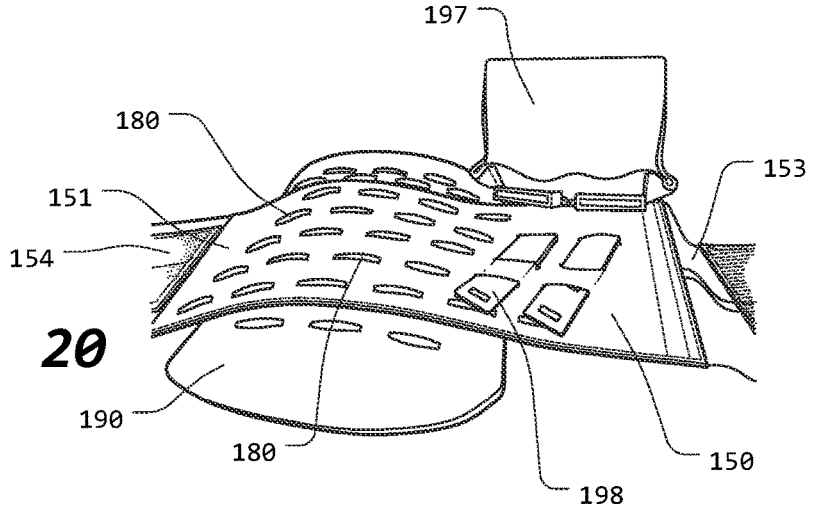
FIG. 20 shows a more detailed view of an exemplary embodiment of an accessory being attached or coupled to a cummerbund element, according to an exemplary embodiment of the present disclosure.
Figure 21:
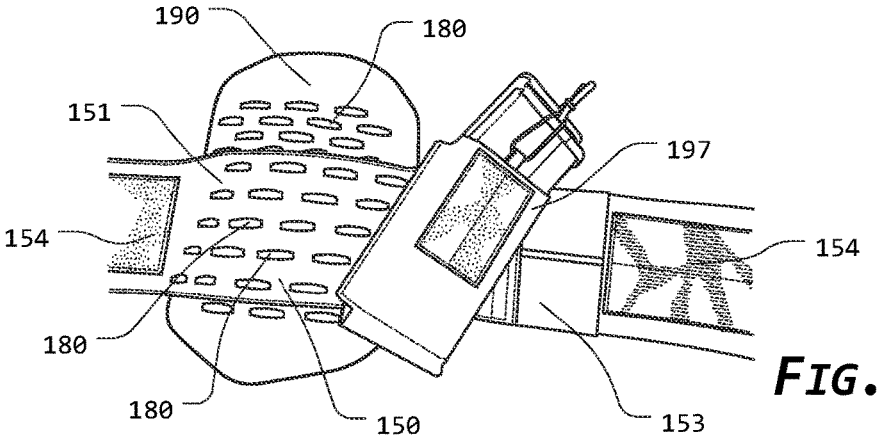
FIG. 21 shows a more detailed view of an exemplary embodiment of an accessory attached or coupled to a cummerbund element, according to an exemplary embodiment of the present disclosure.
Figure 22:
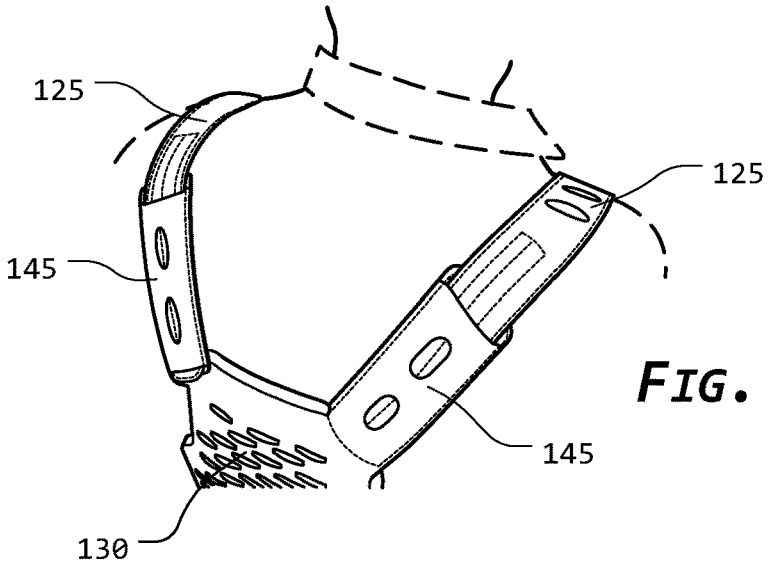
FIG. 22 shows a more detailed upper, rear perspective view of an exemplary embodiment of a plate carrier worn by a user, according to an exemplary embodiment of the present disclosure.
Figure 23:
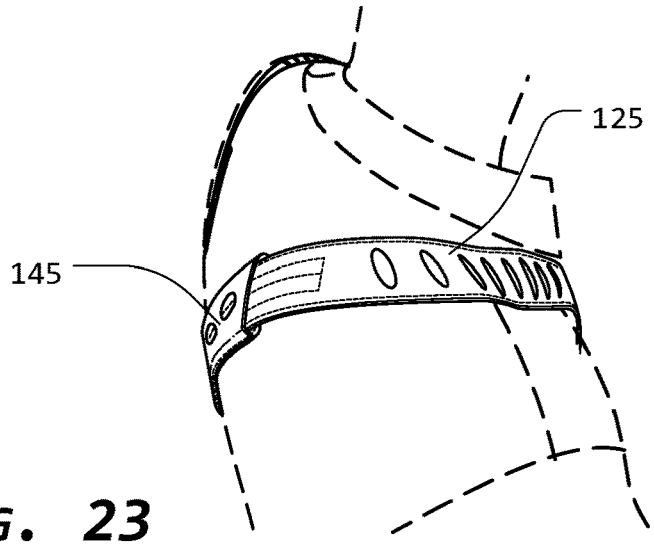
FIG. 23 shows a more detailed upper, side perspective view of an exemplary embodiment of a plate carrier worn by a user, according to an exemplary embodiment of the present disclosure.
Figure 24:
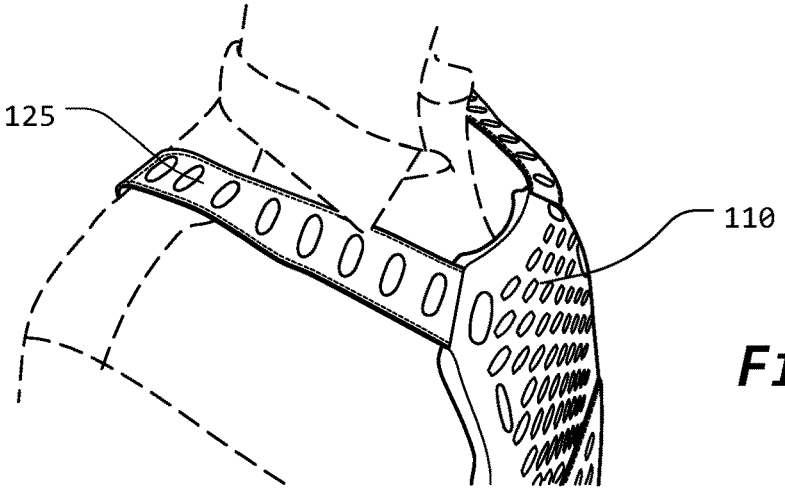
FIG. 24 shows a more detailed upper, front perspective view of an exemplary embodiment of a plate carrier worn by a user, according to an exemplary embodiment of the present disclosure.
Figure 25:
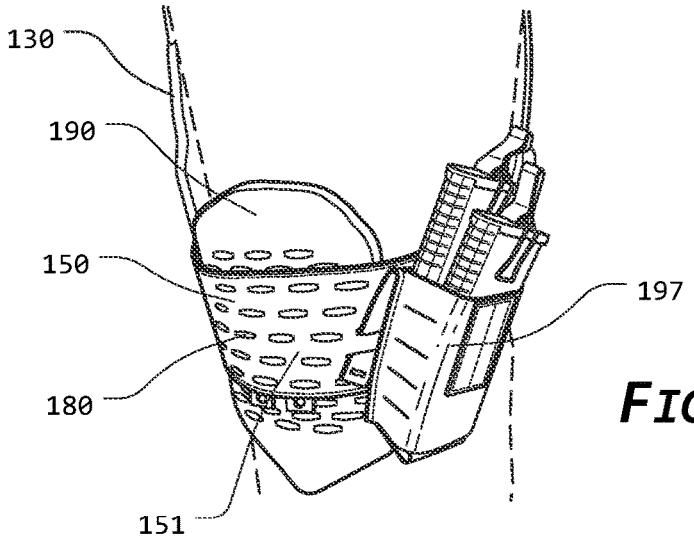
FIG. 25 shows a more detailed side perspective view of an exemplary embodiment of a plate carrier with an attached or coupled side plate carrier and accessory worn by a user, according to an exemplary embodiment of the present disclosure.
Figure 26:
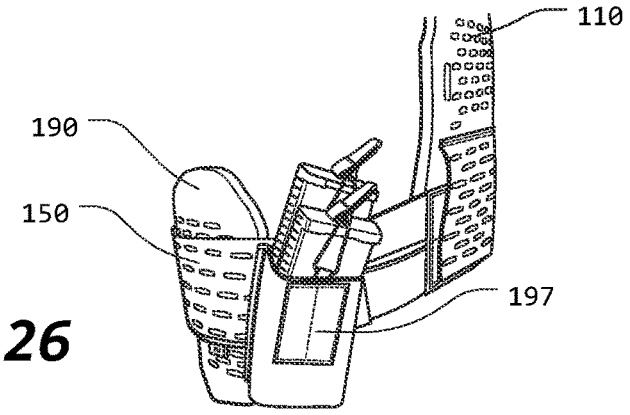
FIG. 26 shows a more detailed side perspective view of an exemplary embodiment of a plate carrier with an attached or coupled side plate carrier and accessory worn by a user, according to an exemplary embodiment of the present disclosure.
Figure 27:
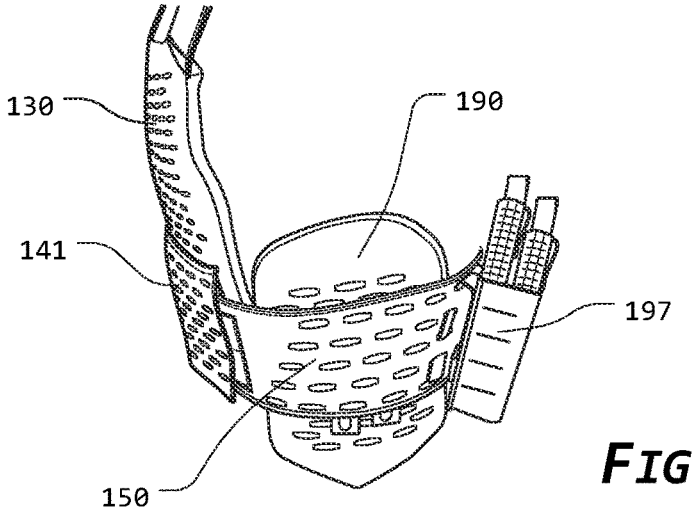
FIG. 27 shows a more detailed side perspective view of an exemplary embodiment of a plate carrier with an attached or coupled side plate carrier and accessory worn by a user, according to an exemplary embodiment of the present disclosure.
Figure 28:
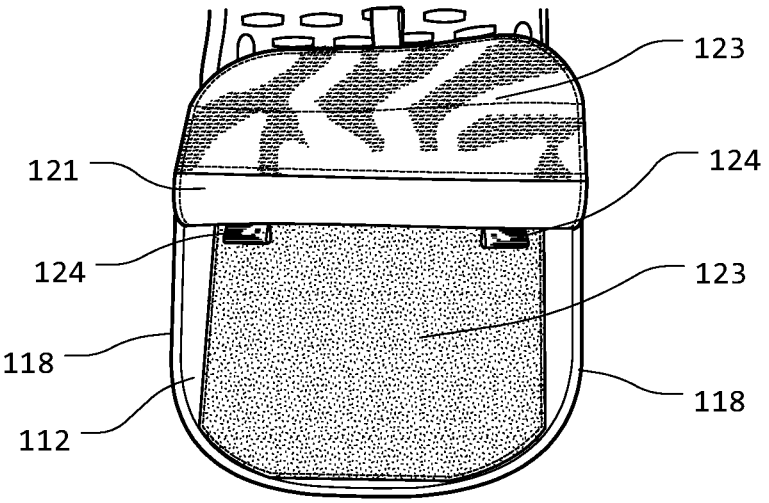
FIG. 28 shows a more detailed front view of an exemplary embodiment of a front carrier, wherein the front panel flap is lifted to a disengaged position, according to an exemplary embodiment of the present disclosure.
Figure 29:
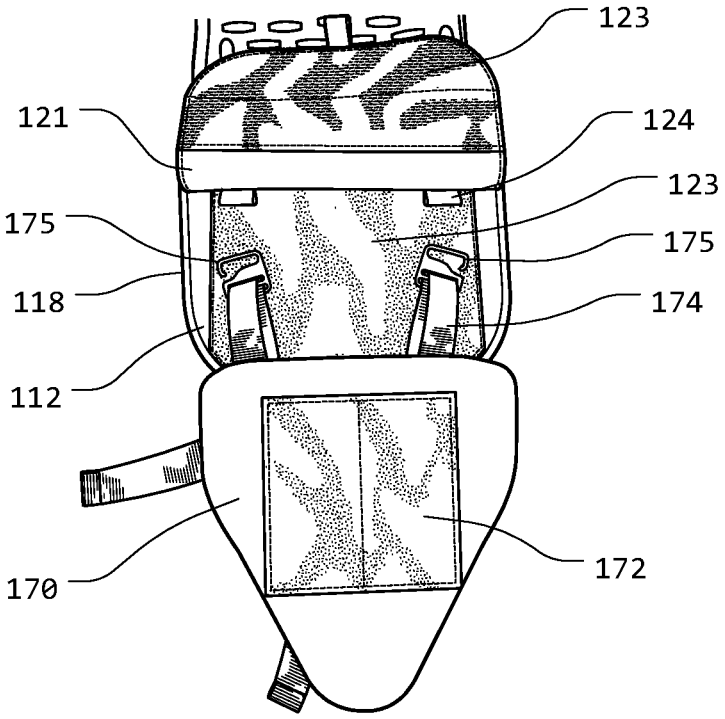
FIG. 29 shows a more detailed front view of an exemplary embodiment of a front carrier, wherein the front panel flap is lifted to a disengaged position and a groin protector is aligned, according to an exemplary embodiment of the present disclosure.
Figure 30:
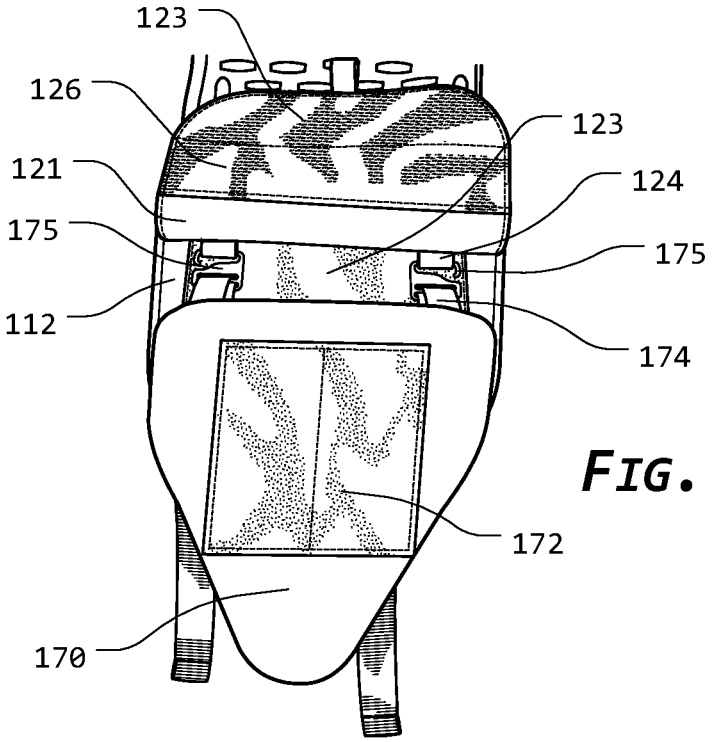
FIG. 30 shows a more detailed front view of an exemplary embodiment of a front carrier, wherein the front panel flap is lifted to a disengaged position and a groin protector is attached or coupled, according to an exemplary embodiment of the present disclosure.
Figure 31:
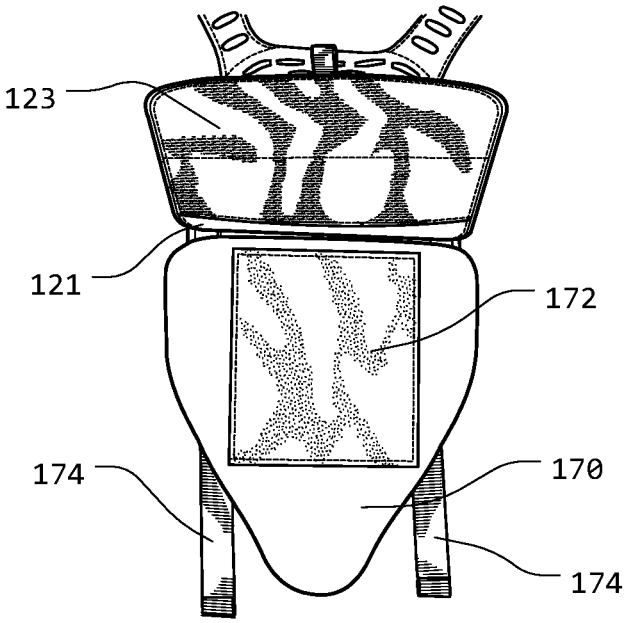
FIG. 31 shows a more detailed front view of an exemplary embodiment of a front carrier, wherein the front panel flap is lifted to a disengaged position and a groin protector is attached or coupled in a retracted position, according to an exemplary embodiment of the present disclosure.
Figure 32:
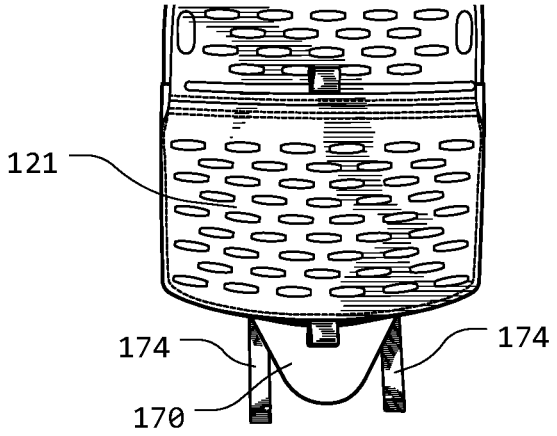
FIG. 32 shows a more detailed front view of an exemplary embodiment of a front carrier, wherein a groin protector is attached or coupled in a retracted position and the front panel flap is in an engaged positioned above the groin protector, according to an exemplary embodiment of the present disclosure.
Figure 33:
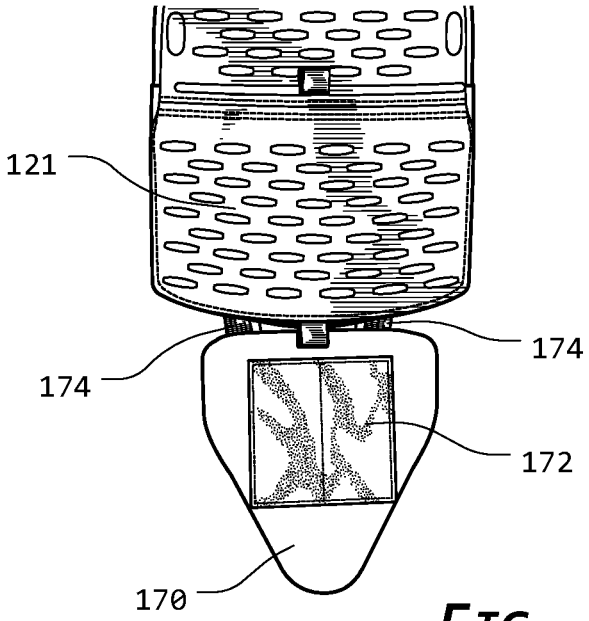
FIG. 33 shows a more detailed front view of an exemplary embodiment of a front carrier, wherein a groin protector is attached or coupled in an extended position and the front panel flap is in an engaged positioned above the groin protector, according to an exemplary embodiment of the present disclosure.
Figure 34:
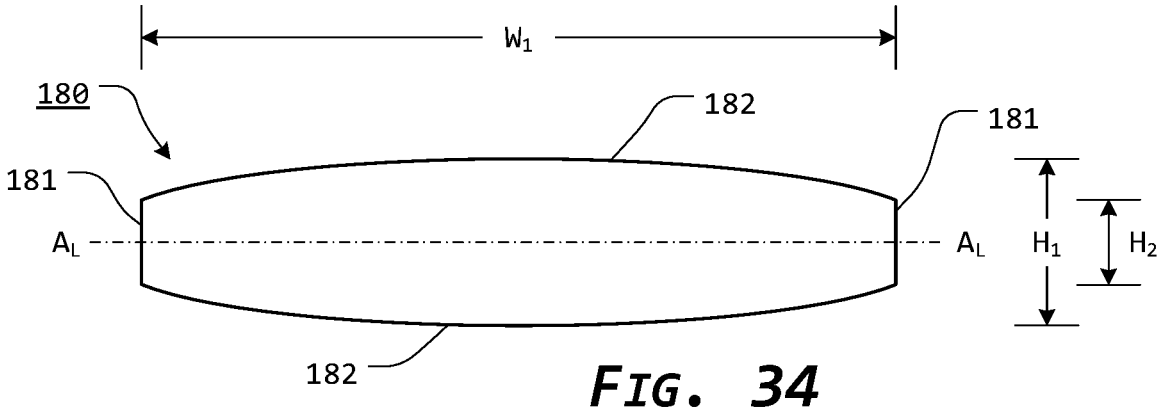
FIG. 34 illustrates an exemplary embodiment of an attachment aperture, according to an exemplary embodiment of the present disclosure.
Figure 35:
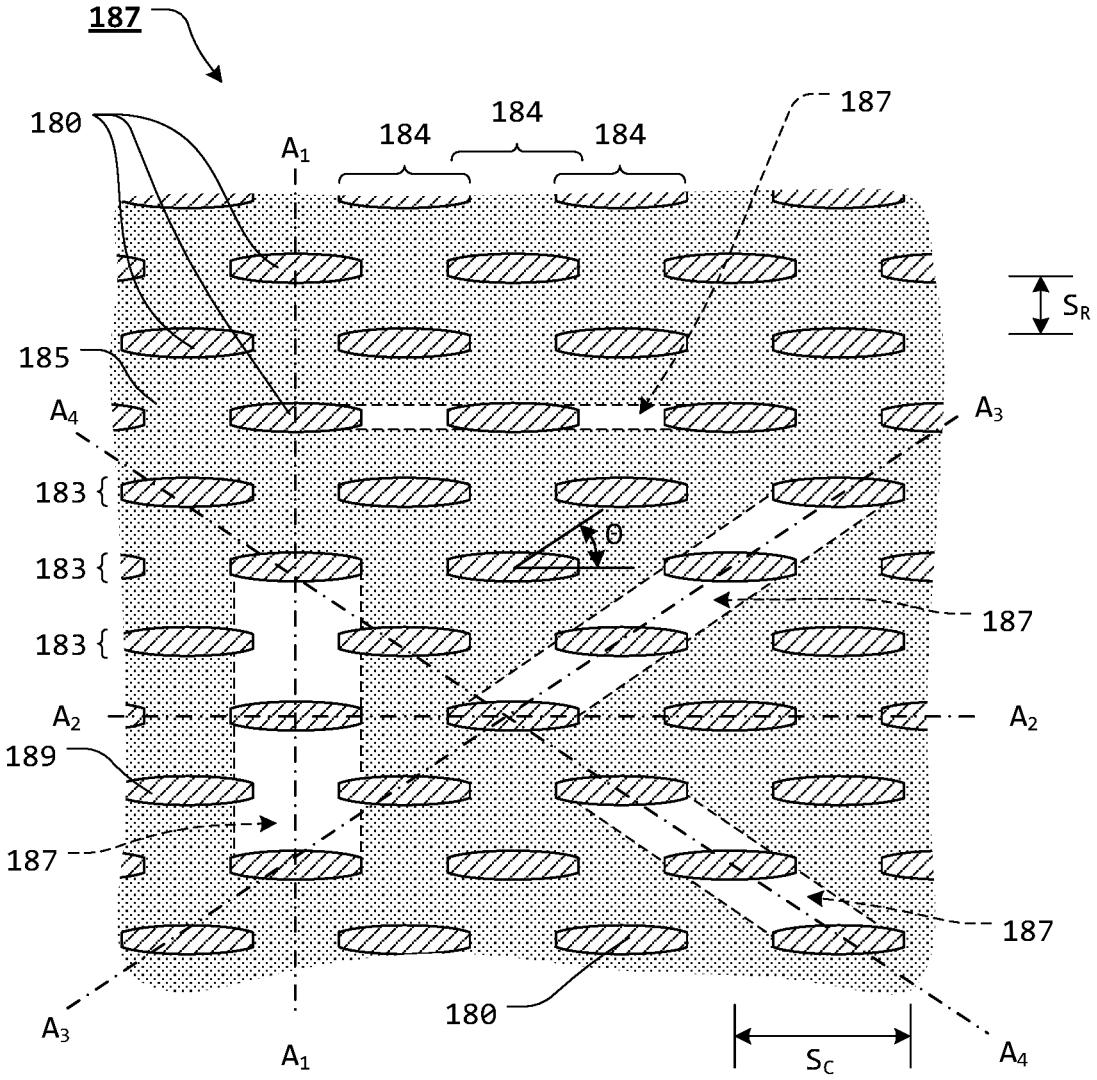
FIG. 35 illustrates an exemplary embodiment of the attachment aperture array, according to an exemplary embodiment of the present disclosure.
Figure 36:
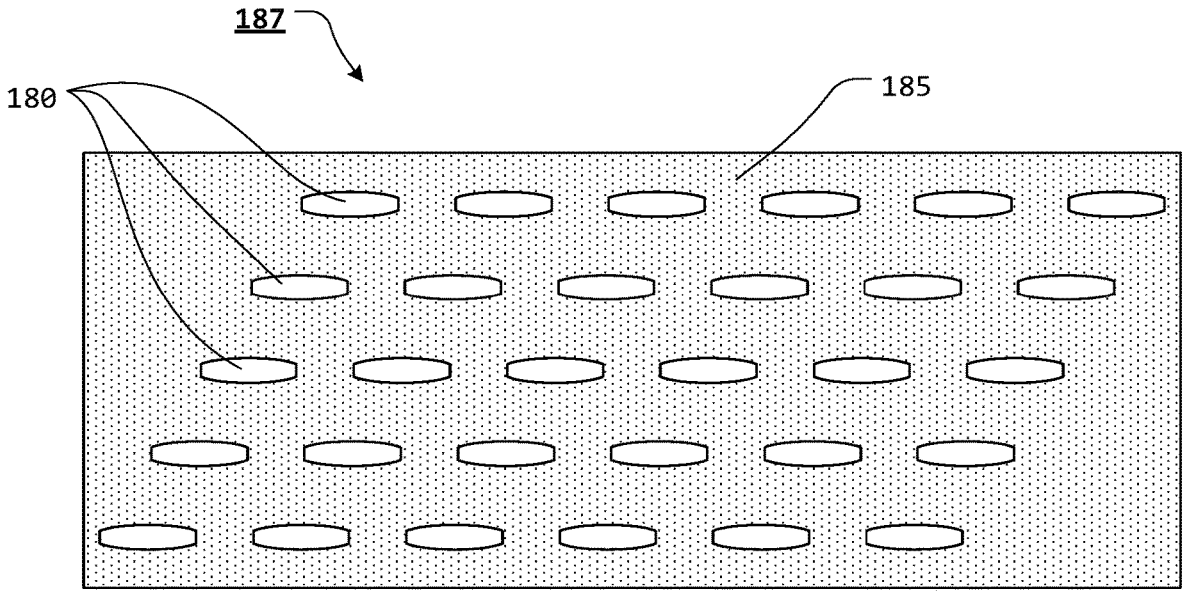
FIG. 36 illustrates an exemplary embodiment of the attachment aperture array, according to an exemplary embodiment of the present disclosure.
Figure 37:
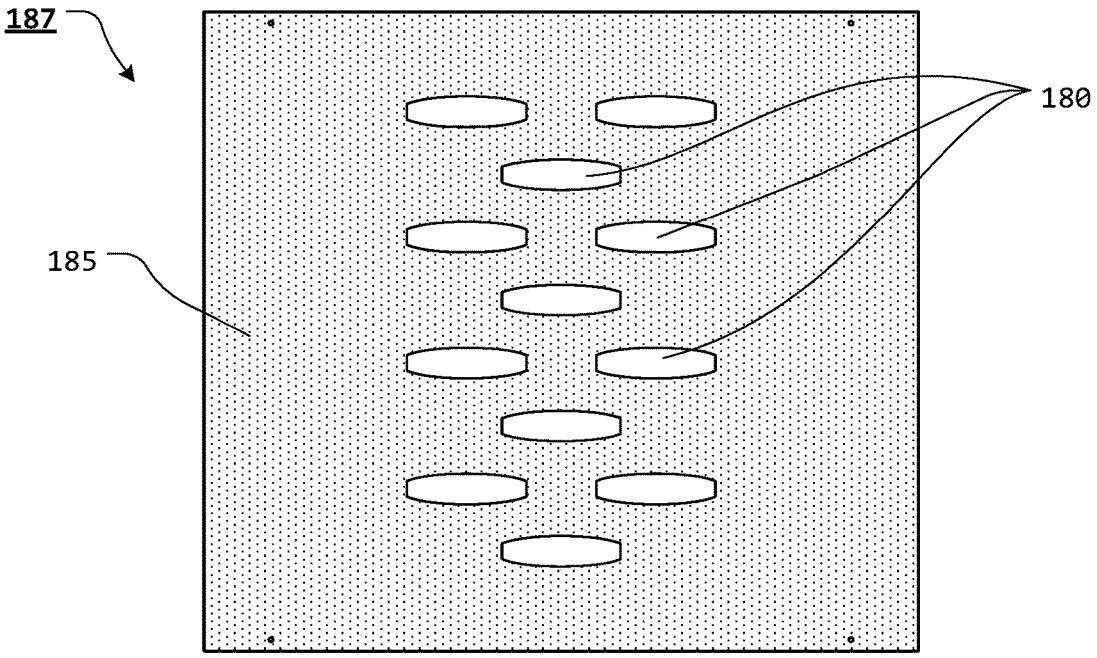
FIG. 37 illustrates an exemplary embodiment of the attachment aperture array, according to an exemplary embodiment of the present disclosure.

As illustrated most clearly in FIGS. 3-4, the back carrier 130 comprises at least some of a back attachment layer 132, an outer back panel 133 and an inner back panel 134. The back attachment layer 132 is attached or coupled atop the outer back panel 133 and is secured proximate a joint perimeter of the back attachment layer 132 and the outer back panel 133. In various exemplary embodiments, a carrier pocket 115 may optionally be formed between a lower portion of the outer back panel 133 and the back attachment layer 132. A carrier pocket opening 116 may optionally be provided to allow access to at least a portion of the carrier pocket 115.

The inner back panel 134 is attached or coupled to at least a portion of the outer back panel 133 such that a back carrier plate cavity 137 is formed between the outer back panel 133 and the inner back panel 134.

In various exemplary embodiments, the inner back panel 134 is attached or coupled to the back attachment layer 132 and the outer back panel 133 by a back panel gusset 138. While the inner back panel 134 may be or coupled directly to the back attachment layer 132 and the outer back panel 133, by including a back panel gusset 138 between the inner back panel 134 and the back attachment layer 132 and outer back panel 133, added strength or expansion may optionally be provided by the back panel gusset 138 and the back panel gusset 138 may optionally provide for a side wall of the back carrier plate cavity 137 that more accurately mimics the side profile of a ballistic or other plate that is to be inserted within the back carrier plate cavity 137. Furthermore, the inclusion of the back panel gusset 138 may optionally also provide a more wear resistant edge or side portion to the exterior area surrounding the edge or side portion of the back carrier plate cavity 137.

In various exemplary, nonlimiting embodiments, the back panel gusset 138 comprises a substantially rectangular portion of material that extends around the outer perimeter of the inner back panel 134.

In various exemplary embodiments, an inner back panel flap 140 extends from a bottom portion of the outer back panel 133 to wraparound and be attached or coupled to a bottom portion of the inner back panel 134. The inner back panel flap 140 may be an integral extension of the outer back panel 133 or may comprise a separate portion of material that is attached or coupled to a bottom portion of the outer back panel 133.

A back carrier plate cavity opening 139 is provided proximate a bottom or open edge of the inner back panel 134, between a terminal or overlapping and portion of the inner back panel 134 and the inner back panel flap 140.

In various exemplary embodiments, a back carrier plate cavity releasable fastener element 131, such as, for example, corresponding portions of a hook and loop fastener or VELCRO® is provided proximate the back carrier plate cavity opening 139 (on an exterior surface of the inner back panel flap 140 and an interior surface of the inner back panel 134) to allow for closure of the back carrier plate cavity opening 139.

It should be appreciated that, in various exemplary embodiments the back carrier plate cavity releasable fastener element 131 may comprise other releasable devices or releasable fasteners, such as, for example, male/female snap-release buckles, a ZIPLOC® fastening device, a zipper, buttons, snaps, or other fastening, closure, or attachment devices known by those skilled in the art.

The back carrier plate cavity opening 139 is formed so as to allow a ballistic or other panel or plate to be inserted through the back carrier plate cavity opening 139 and into the back carrier plate cavity 137. Once properly inserted, the back carrier plate cavity releasable fastener element 131 may optionally be utilized to maintain the back carrier plate cavity opening 139 in an engaged or closed position.

The back panel flap 141 is attached or coupled, at an upper portion of the back panel flap 141, to the back attachment layer 132. The back panel flap 141 then extends downward, so as to be secured or releasably coupled to the back attachment layer 132 by mating portions of a back panel flap releasable fastener portion 143. In various exemplary embodiments, the back panel flap releasable fastener portion 143 may comprise a hook and loop fastener, such as VELCRO®. It should be appreciated that, in various exemplary embodiments the back panel flap releasable fastener portion 143 may comprise other releasable coupler or releasable fasteners, such as, for example, male/female snap-release buckles, a ZIPLOC® fastening device, a zipper, buttons, snaps, or other fastening, closure, or attachment device known by those skilled in the art.

An inner surface of the back panel flap 141 (i.e., the inner surface of the back panel flap front panel 146) includes a back panel flap releasable fastener portion 143 and the outer surface of the back attachment layer 132 also includes a mating back panel flap releasable fastener portion 143.

In various exemplary embodiments, back panel flap 141 comprises a back panel flap front panel 146 having a back panel flap attachment layer 142 attached or coupled atop the back panel flap front panel 146. One or more attachment apertures 180 are formed through the back panel flap attachment layer 142.

The back carrier 130 includes two, integral informed, back shoulder strap extensions 145 that extend from an upper portion of the back carrier 130 to back shoulder strap terminating ends 149 of the back shoulder strap extensions 145. In various exemplary embodiments, the back shoulder strap extensions 145 are formed as an integral extension of the outer back panel 133 and the back attachment layer 132. A shoulder strap channel 147 is formed between the outer back panel 133 and the back attachment layer 132 within a portion of each of the back shoulder strap extensions 145.

A back shoulder strap releasable fastener element 148 is attached to a portion of a surface of the outer back panel 133 or the back attachment layer 132 within the shoulder strap channel 147 formed between the outer back panel 133 and the back attachment layer 132. The back shoulder strap releasable fastener elements 148 are selected so as to matingly correspond to the front shoulder strap releasable fastener elements 128 of the front shoulder strap extensions 125. In various exemplary embodiments, the back shoulder strap releasable fastener element 148 comprises the VELCRO® or directional VELCRO®.

A front shoulder strap entry slot 136 is formed in each back shoulder strap extensions 145, proximate a terminal end of the back shoulder strap extensions 145. The front shoulder strap entry slot 136 permits access to the shoulder strap channel 147 proximate the back shoulder strap terminating end 149 of the back shoulder strap extensions 145. A front shoulder strap exit slot 144 is formed in the back shoulder strap extensions 145 proximate the back carrier plate cavity 137. The front shoulder strap exit slot 144 permits access to the shoulder strap channel 147 proximate the back carrier plate cavity 137. A front shoulder strap carrier slot 135 is formed in the back attachment layer 132 and provides access to the back carrier plate cavity 137, formed between the outer back panel 133 and the back attachment layer 132.

The cummerbund elements 150 including outer cummerbund attachment layer 151 and an inner cummerbund attachment layer 152. The outer cummerbund attachment layer 151 and the inner cummerbund attachment layer 152 optionally extend to include elastic portions 153 at either terminated end. Releasable fastener portions 154 are attached or coupled to terminating ends of the elastic portions 153. The releasable fastener portions 154 include a releasable fastener portion 154 on both sides of the releasable fastener portion 154. The releasable fastener portions 154 are selected to matingly engage the front panel flap releasable fastener portion 123 of the front panel flap 121 and the front panel flap releasable fastener portion 123 of the front attachment layer 112 and/or the back panel flap releasable fastener portion 143 of the back panel flap 141 and the back panel flap releasable fastener portion 143 of the back attachment layer 132.

Each of the releasable fastener portions 154 of the cummerbund elements 150 may optionally comprise a mating pair of coupling elements, a male coupling element and a corresponding female coupling element. In this manner, the male coupling element may be attached or coupled to a corresponding female coupling element of the front panel flap releasable fastener portion 123 of the front panel flap 121 or the outer front panel 113, proximate the front panel flap 121. Alternatively, the female coupling element may be attached or coupled to the releasable fastener element of the front panel flap releasable fastener portion 123 of the front panel flap 121 for the outer front panel 113, proximate the front panel flap 121.

In various exemplary embodiments, not illustrated herein, one or more of the cummerbund elements 150 may be formed as an integral portion or extension of the outer front panel 113 or the front attachment layer 112 of the front carrier 110 and merely extend from the front carrier 110. Alternatively, one or more of the cummerbund elements 150 may be formed as an integral portion or extension of the outer back panel 133 or the back attachment layer 132 of the back carrier 130 and merely extend from the back carrier 130.

In certain exemplary embodiments, one or more of the outer front panel 113, front attachment layer 112, inner front panel 114, outer back panel 133, back attachment layer 132, and/or the inner back panel 134 may optionally be formed of a portion of a fabric-type or other material, such as, for example, chlorosulfonated polyethylene (CSPE) synthetic rubber (CSM). In certain exemplary embodiments, one or more of the outer front panel 113, front attachment layer 112, inner front panel 114, outer back panel 133, back attachment layer 132, and/inner back panel 134 may optionally be formed of a portion of Hypalon fabric. However, the present disclosure is not so limited. For example, in certain exemplary embodiments, one or more of the outer front panel 113, front attachment layer 112, inner front panel 114, outer back panel 133, back attachment layer 132, and/inner back panel 134 may optionally be formed of a rigid material, a semi-rigid material, or a substantially flexible material.

In various exemplary, non-limiting embodiments, all or portions of one or more of the outer front panel 113, front attachment layer 112, inner front panel 114, outer back panel 133, back attachment layer 132, and/inner back panel 134 may optionally be formed of may be made of any fabric or other material, such as, for example, woven fabrics, canvas, acrylics, sheet fabrics, films, nylon, spandex, vinyl, Polyvinyl Chloride (PVC), neoprene, or the like. Alternatively, all or portions of one or more of the outer front panel 113, front attachment layer 112, inner front panel 114, outer back panel 133, back attachment layer 132, and/inner back panel 134 may optionally be formed of may be formed from multiple, similar or dissimilar materials. In various exemplary, non-limiting embodiments, one or more of the outer front panel 113, front attachment layer 112, inner front panel 114, outer back panel 133, back attachment layer 132, and/inner back panel 134 may optionally be formed of may be water-resistant or may include a cushion material.

It should be appreciated that the terms fabric and material are to be given their broadest meanings and that the particular fabric(s) or material(s) used to form one or more of the outer front panel 113, front attachment layer 112, inner front panel 114, outer back panel 133, back attachment layer 132, and/inner back panel 134 may optionally be formed of is a design choice based on the desired appearance and/or functionality of the plate carrier 100.

Additionally, the material used to form the inner front panel 114 and the inner back panel 134 may comprise certain elastic properties, allowing the inner front panel 114 and the inner back panel 134 to expand or contract to better accommodate a ballistic panel or plate.

The cummerbund elements 150 serve to couple the front carrier 110 to the back carrier 130 by being attached or coupled to the front panel flap releasable fastener portions 123 when the front panel flap 121 of the back panel flap 141 are in the engaged positions.

Attachment apertures 180 are formed in the inner cummerbund attachment layer 152 and attachment apertures 180 are formed outer cummerbund attachment layer 151. In various exemplary embodiments, the attachment apertures 180 are formed in various aperture matrix arrays. For example, the attachment apertures 180 may optionally be arranged in an aperture matrix array that allows accessories, such as, for example, a side plate carrier 190, to be attached or coupled to the inner cummerbund attachment layer 152 in a substantially vertical manner relative to the cummerbund element 150. In this manner, the side plate carrier 190 may optionally be oriented substantially perpendicular to the longitudinal axis of the plate carrier 100.

As illustrated, the side plate carrier 190 may optionally include at least an outer, side plate attachment layer 191 having a plurality of spaced apart, attachment apertures 180 formed therethrough.

In other exemplary embodiments, the attachment apertures 180 may optionally be arranged in an aperture matrix array that allows accessories, such as, for example, a magazine pouch, to be attached or coupled to the outer cummerbund attachment layer 151 in a substantially acute or obtuse manner relative to the cummerbund element 150. In this manner, the accessory 197 may optionally be oriented at an acute or obtuse angle relative to the longitudinal axis of the plate carrier 100.

During assembly or attachment of the front carrier 110 to the back carrier 130, the front shoulder strap terminating end 129 of each front shoulder strap extension 125 is urged through the front shoulder strap entry slot 136 and into the shoulder strap channel 147 between the outer back panel 133 and the back attachment layer 132. The front shoulder strap terminating end 129 of each front shoulder strap extension 125 is then passed through the shoulder strap channel 147 and exits the front shoulder strap exit slot 144. Once the front shoulder strap extension 125 is appropriately inserted within or through the shoulder strap channel 147, the front shoulder strap terminating end 129 of the front shoulder strap extension 125 may optionally be positioned through the front shoulder strap carrier slot 135 (if there is a sufficient length of the shoulder front shoulder strap extension 125), such that an excessive amount of the front shoulder strap extension 125 may optionally be tucked under the front attachment layer 112 of the front carrier 110.

Once the front shoulder strap extension 125 is appropriately inserted within or through the shoulder strap channel 147, engagement between the back shoulder strap releasable fastener element 148 and the front shoulder strap releasable fastener element 128 maintain the position of the front shoulder strap extension 125 relative to the back shoulder strap extensions 145.

In various exemplary embodiments, a releasable fastener separator 196 may optionally be utilized to keep the front shoulder strap releasable fastener element 128 separate or away from the back shoulder strap releasable fastener element 148, while the front shoulder strap extension 125 is being positioned within the shoulder strap channel 147. Once appropriately positioned, the releasable fastener separator 196 is withdrawn or removed from the shoulder strap channel 147, allowing engagement between the front shoulder strap releasable fastener element 128 and the back shoulder strap releasable fastener element 148. A releasable fastener separator 196 may optionally also be utilized to disengage or release the front shoulder strap releasable fastener element 128 from the back shoulder strap releasable fastener element 148 such that the front shoulder strap extension 125 may optionally be adjusted or withdrawn relative to the back shoulder strap extensions 145.

In various exemplary embodiments, attachment apertures 180 are formed through various portions of the front attachment layer 112, the back attachment layer 132, the front panel flap 121, the back panel flap attachment layer 142, the inner cummerbund attachment layer 152, the outer cummerbund attachment layer 151, and/or the side plate attachment layer 191. The attachment apertures 180 are arranged in attachment aperture arrays 187.

FIGS. 34-37 illustrate certain elements and/or aspects of an exemplary embodiment of an attachment aperture array 187 that may optionally be used with portions of the plate carrier 100, side plate carrier 190, and/or accessory 197.

In certain illustrative, non-limiting embodiment(s) of the present disclosure, as illustrated in FIGS. 34-37, the attachment aperture array 187 comprises at least some of an attachment layer 185 having a plurality of spaced apart attachment apertures 180 formed therethrough, with channel segments 187 formed between certain of the spaced apart attachment apertures 180, between the attachment layer 185 (i.e., the front attachment layer 112, the back attachment layer 132, the front panel flap 121, the back panel flap attachment layer 142, the inner cummerbund attachment layer 152, the outer cummerbund attachment layer 151, and/or the side plate attachment layer 191) and the outer panel 189 (i.e., the outer front panel 113, the outer back panel 133, etc.).

As illustrated, the attachment aperture array 187 includes an attachment layer 185 having two or more attachment apertures 180 formed therethrough at spaced apart locations and arranged in one or more rows 183 and/or columns 184. The attachment layer 185 is at least partially attached or coupled to an outer panel 189 and channel segments 187 (i.e. shoulder strap channel 147) are formed between adjacent attachment apertures 180. The attachment aperture array 187 of the present disclosure is operable with as few as two attachment apertures 180. Thus, the size and shape of the attachment layer 185 is a design choice, based upon, for example, the size and shape of the outer panel 189 or portion of outer panel 189 that is desired to potentially accept attachment or coupling of accessories.

As illustrated, the attachment aperture 180 includes an exemplary height, $H_1$, a second height, $H_1$, and an exemplary width, $W_1$. Each attachment aperture 180 is formed of two substantially equal length, parallel side portions 181, each having a height, $H_2$. It should be appreciated that the width, $W_1$, between of each of the side portions 181 is a design choice based upon the desired functionality and/or appearance of the attachment aperture 180.

Arcuate sides 182 join respective upper terminal ends and respective lower terminal ends of each of the side portions 181. In various exemplary embodiments, the height, $H_1$, is formed between apexes of the arcuate sides 182. It should be appreciated that the height, $H_1$, between apexes of arcuate side 182 is a design choice based upon the desired functionality and/or appearance of the attachment aperture 180. Thus, the angle of each arc forming each arcuate side 182 may be formed based upon the desired functionality and/or appearance of each attachment aperture 180.

Each attachment aperture 180 is generally formed as an aperture or hole through the attachment layer 185. It is possible for the attachment layer 185 to operate as a standalone element, such as, for example, a sheet of attachment layer 185 material, to which compatible accessories may be attached or coupled. However, in various exemplary embodiments, the attachment layer 185 is at least partially attached or coupled to at least a portion of a carrier or carrier material, such as, for example, an outer panel 189.

The overall size of each attachment aperture 180 is also a design choice. In certain exemplary embodiments, the size of each attachment aperture 180 is influenced or dictated by the width of the accessory coupling element 198 of a compatible accessory 197, such as, for example, the accessory coupling element 198 of a compatible accessory 197. For example, if the accessory coupling element 198 has a width of approximately 1 inch, the width, $W_1$, between of each of the at least substantially planar side portions 181 may optionally be approximately 1 inch, so as to allow the accessory coupling element 198 to be fitted within and interwoven between two or more attachment apertures 180. Alternatively, the width, $W_1$, between of each of the side portions 181 may be such that only certain accessories are compatible with the attachment layer 185 and the aperture array 187.

The attachment apertures 180 may optionally be arranged in a repeating or semi-repeating series or sequence of spaced apart, repeating patterns. In various exemplary embodiments, the attachment apertures 180 are arranged in a repeating or semi-repeating series or sequence of spaced apart rows 183 and columns 184. In various exemplary embodiments, the attachment apertures 180 are arranged in a series of equally spaced rows 183 and equally spaced columns 184.

In certain exemplary embodiments, each of the rows 183 is spaced at a distance that is the same as the spacing between each of the columns 184. Alternatively, the spacing between each of the rows 183 is greater than or less than the spacing between each of the columns 184.

In various exemplary embodiments, the spacing between either edges or proximate centers of adjacent attachment apertures 180 (whether vertically, horizontally, obliquely, or diagonally adjacent) is influenced or dictated by the width of the accessory coupling element 198 of a compatible accessory 197. For example, if the accessory coupling element 198 has a width of approximately 1 inch, the spacing between either edges or proximate centers of adjacent attachment apertures 180 may optionally be approximately 1 inch, so as to allow the accessory coupling element 198(*s*) to be appropriately aligned between every other attachment aperture 180 in a vertical, horizontal, oblique, or diagonal direction. Alternatively, the spacing between either edges or proximate centers of adjacent attachment apertures 180 may be created such that only certain accessories are compatible with the attachment layer 185 and the aperture array.

It should be appreciated that two or more adjacent attachment apertures 180 may comprise a row 183 and two or more adjacent attachment apertures 180 may comprise a column 184. Thus, it should be appreciated that the number of attachment apertures 180 formed in the attachment layer 185 is a design choice based upon the desired size and/or functionality of the attachment layer 185.

In various exemplary, nonlimiting embodiments, each adjacent row 183 and/or column 184 of spaced apart attachment apertures 180 is offset such that either edges or proximate centers of adjacent attachment apertures 180 are offset by approximately ±45°, approximately ±33°, or approximately ±90°. If for example, either edges or proximate centers of adjacent attachment apertures 180 are offset by ±45°, ±33°, or ±90°, an attached or coupled accessory 197 may be attached or coupled at least at ±0°, ±90°, ±33°, or ±45°. Thus, it should be appreciated that the offset of adjacent rows 183 and/or columns 184 dictates the angle of oblique attachment of accessories.

In certain exemplary, nonlimiting embodiments, each attachment aperture 180 may be separated from each other attachment aperture 180 by a distance that is equal to or greater than a width of each attachment aperture 180. Alternatively, each attachment aperture 180 may be separated from each other attachment aperture 180 by a distance that is equal to or greater than a width of each attachment aperture 180.

By arranging the attachment apertures 180 in a repeating or semi-repeating series or sequence, aperture array channel segments 187 are created between adjacent attachment apertures 180 (whether vertically, horizontally, obliquely, acutely, or diagonally adjacent).

In various exemplary, nonlimiting embodiments, the attachment layer 185 comprises a portion of attachment layer 185 material that is at least partially attached or coupled to an outer panel 189 by aperture array layer attachment elements, such as stitching proximate a perimeter of the attachment layer 185. The attachment layer 185 may optionally be attached or coupled or further attached or coupled to the outer panel 189, via additional aperture array layer attachment elements (not illustrated). The aperture array layer attachment elements (not illustrated) may be spaced apart, as necessary or desirable, in order to further secure, attach, or couple the attachment layer 185 to the outer panel 189. The number and placement of additional aperture array layer attachment elements (not illustrated) is a design choice based upon the desired level of securement of the attachment layer 185 to the outer panel 189 and/or to further ensure that the attachment layer 185 will not separate or pull away from the outer panel 189, particularly if accessories are attached or coupled to the attachment layer 185.

In certain exemplary embodiments, the aperture array layer attachment elements comprise stitching. Alternatively, the attachment layer 185 may be attached or coupled to the outer panel 189 at one or more aperture array layer attachment elements (not illustrated) via adhesive bonding, welding, screws, rivets, pins, mating hook and loop portions, snap or releasable fasteners, or other known or later developed means or methods for permanently or releasably attaching or coupling the attachment layer 185 to the outer panel 189. The one or more aperture array layer attachment elements (not illustrated) may be formed or positioned proximate a perimeter of the attachment layer 185 or in one or more areas located within the one or more attachment layers 185.

In addition to the variability of size and shape of the attachment layer 185, the orientation of the attachment layer 185, relative to the outer panel 189, is also a design choice. Thus, the attachment layer 185 may optionally be attached or coupled to the outer panel 189, such that the rows 183 of attachment apertures 180 are substantially parallel to a longitudinal or other axis, along the length, of the exemplary outer panel 189, while the columns 184 of attachment apertures 180 are substantially perpendicular to the longitudinal or other axis of the outer panel 189. It should be appreciated that this is merely exemplary and the attachment layer 185 may be attached at any desired angular or rotational orientation relative to the outer panel 189.

The portions of material of the attachment layer 185 between adjacent attachment apertures 180 form aperture array channel segments 187. If the attachment layer 185 is attached to an outer panel 189, the aperture array channel segments 187 are formed between at least portions of the attachment layer 185 and at least portions of the surface of the outer panel 189. The aperture array channel segments 187 provide areas for securing the accessory coupling element 198 of an accessory 197 to the attachment layer 185. In this manner, an accessory coupling element 198 may be interwoven between the aligned aperture array channel segments 187 to removably attach the accessory 197 to the outer panel 189.

During attachment of an exemplary accessory 197, the accessory 197 is aligned with the attachment layer 185 in a desired orientation. The accessory 197 may optionally be aligned with the attachment layer 185 in a generally vertical or horizontal manner or a generally oblique or diagonal manner. It should be understood that these orientations are relative to the orientation of the attachment layer 185 and the orientation of the attachment layer 185 relative to any optional outer panel 189.

The exemplary accessory 197 includes one or more substantially parallel, spaced apart accessory coupling elements 198. If more than one accessory coupling element 198 is included, the accessory coupling elements 198 are spaced apart so as to correspond to the spaces between the spaced apart attachment apertures 180.

When the accessory 197 is placed adjacent the attachment layer 185 such that at least a portion of the accessory coupling elements 198 are within a portion of the spaces between the spaced apart attachment apertures 180 (and at least a portion of the attachment apertures 180 are within the spaces between the spaced apart accessory coupling elements 198) and corresponding aperture array channel segments 187 and accessory channel segments 187 are aligned, the accessory coupling element 198 may be interwoven between the aligned aperture array channel segments 187 and accessory channel segments 187 (alternating between adjacent attachment apertures 180 of the attachment layer 185 and accessory coupling elements 198 on the accessory 197) to removably attach the accessory 197 to the attachment layer 185.

Thus, an accessory 197 may be mounted to the attachment layer 185 in a variety of orientations. Likewise, if a particular outer panel 189 includes an attachment layer 185, a variety of accessories may be interchangeably mounted to the attachment layer 185 to accommodate a variety of desired configurations.

It should be appreciated that a more detailed explanation of the instructions regarding how to interweave the accessory coupling element 198 between the attachment apertures 180 and accessory coupling elements 198 is not provided herein because, while the attachment layer 185 provides more orientation options and other features, accessories are generally attached to the attachment layer 185 in a manner similar to the manner in which accessories are attached to a portion of MOLLE webbing. Therefore, it is believed that the level of description provided herein is sufficient to enable one of ordinary skill in the art to understand and practice the systems, methods, devices, and/or apparatuses, as described.

While the presently disclosed systems, methods, devices, and/or apparatuses have been described in conjunction with the exemplary embodiments outlined above, the foregoing description of exemplary embodiments of the present disclosure, as set forth above, are intended to be illustrative, not limiting and the fundamental disclosed systems, methods, devices, and/or apparatuses should not be considered to be necessarily so constrained. It is evident that the present disclosure is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the present disclosure. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which the present disclosure belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the present disclosure, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the present disclosure.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A plate carrier, comprising:

a front carrier having front shoulder strap extensions formed integral to said front carrier, wherein said front shoulder strap extensions extend from a portion of said front carrier; and a back carrier having back shoulder strap extensions formed integral to said back carrier, wherein said back shoulder strap extensions extend from a portion of said back carrier, wherein each of said back shoulder strap extensions includes a shoulder strap channel formed through at least a portion of said back shoulder strap extension such that at least a portion of one of said front shoulder strap extension may be received within at least a portion of each respective shoulder strap channel, and wherein each of said front shoulder strap extensions includes a front shoulder strap releasable hook and loop fastener element and wherein at least a portion of a back shoulder strap releasable hook and loop fastener element is attached or coupled within said shoulder strap channel to releasably interact with said front shoulder strap releasable hook and loop fastener element if one of said front shoulder strap extensions is appropriately positioned within said shoulder strap channel, such that, in an attached or coupled configuration, a terminating end of each of said front shoulder strap extensions is positioned to extend to said back carrier.

2. The plate carrier of claim 1, wherein at least one cummerbund element releasably attaches or couples said front carrier to said back carrier.

3. The plate carrier of claim 1, wherein two front shoulder strap carrier slots are formed in a portion of said back carrier, wherein each front shoulder strap carrier slot provides access to a back carrier plate cavity, and wherein, in said attached or coupled configuration, at least said terminating end of said front shoulder strap extension is positionable through said front shoulder strap carrier slot.

4. The plate carrier of claim 1, wherein said front shoulder strap releasable hook and loop fastener element and said back shoulder strap releasable fastener element interact to maintain a position of the front shoulder strap extension within said shoulder strap channel.

5. The plate carrier of claim 1, wherein each of said respective shoulder strap channels includes a front shoulder strap exit slot formed in a portion of each of said respective back shoulder strap extensions proximate the back carrier plate and wherein at least a portion of each of said respective terminating ends of said front shoulder strap extensions is positionable through a respective one of said respective front shoulder strap exit slots.

6. The plate carrier of claim 1, wherein a plurality of attachment apertures are formed through at least a portion of said front carrier and wherein each attachment aperture is defined by two equal length, parallel sides, an arcuate side joining respective upper terminal ends of said parallel sides, and an arcuate side joining respective lower terminal ends of said parallel sides.

7. The plate carrier of claim 1, wherein said front carrier includes a front attachment layer, wherein a plurality of attachment apertures are formed through at least a portion of said front attachment layer.

8. The plate carrier of claim 7, wherein an aperture array is formed in said front attachment layer, wherein said aperture array includes a plurality of attachment apertures arranged in a repeating sequence of spaced rows and spaced columns.

9. The plate carrier of claim 1, wherein a plurality of attachment apertures are formed through at least a portion of said back carrier.

10. The plate carrier of claim 9, wherein each attachment aperture is defined by two equal length, parallel sides, an arcuate side joining respective upper terminal ends of said parallel sides, and an arcuate side joining respective lower terminal ends of said parallel sides.

11. The plate carrier of claim 9, wherein said back carrier includes a back attachment layer, wherein a plurality of attachment apertures are formed through at least a portion of said back attachment layer.

12. The plate carrier of claim 11, wherein an aperture array is formed in said back attachment layer, wherein said aperture array includes a plurality of attachment apertures arranged in a repeating sequence of spaced rows and spaced columns.

13. A plate carrier, comprising:

a front carrier having a front attachment layer, wherein front shoulder strap extensions are formed integral to said front attachment layer, and wherein said front shoulder strap extensions extend from a portion of said front attachment layer; and a back carrier having a back attachment layer, wherein back shoulder strap extensions are formed integral to said back attachment layer, wherein said back shoulder strap extensions extend from a portion of said back attachment layer, wherein each of said back shoulder strap extensions includes a shoulder strap channel formed through at least a portion of said back shoulder strap extension such that at least a portion of one of said front shoulder strap extensions may be received within at least a portion of each respective shoulder strap channel, and wherein each of said front shoulder strap extensions includes a front shoulder strap releasable hook and loop fastener element and wherein at least a portion of a back shoulder strap releasable hook and loop fastener element is attached or coupled within said shoulder strap channel to releasably interact with said front shoulder strap releasable hook and loop fastener element if one of said front shoulder strap extensions is appropriately positioned within said shoulder strap channel, such that, in an attached or coupled configuration, a terminating end of each of said front shoulder strap extensions is positioned to extend to said back carrier.

14. The plate carrier of claim 13, wherein at least one cummerbund element releasably attaches or couples said front carrier to said back carrier.

15. The plate carrier of claim 13, wherein said front shoulder strap releasable hook and loop fastener element and said back shoulder strap releasable fastener element interact to maintain a position of the front shoulder strap extension within said shoulder strap channel.

16. The plate carrier of claim 13, wherein a plurality of attachment apertures are formed through at least a portion of said front attachment layer.

17. The plate carrier of claim 16, wherein each attachment aperture is defined by two equal length, parallel sides, an arcuate side joining respective upper terminal ends of said parallel sides, and an arcuate side joining respective lower terminal ends of said parallel sides.

18. The plate carrier of claim 13, wherein a plurality of attachment apertures are formed through at least a portion of said back attachment layer.

19. The plate carrier of claim 18, wherein each attachment aperture is defined by two equal length, parallel sides, an arcuate side joining respective upper terminal ends of said parallel sides, and an arcuate side joining respective lower terminal ends of said parallel sides.

20. A plate carrier, comprising:

a front carrier having a front attachment layer, wherein front shoulder strap extensions are formed integral to said front attachment layer, wherein said front shoulder strap extensions extend from a portion of said front attachment layer, and wherein a plurality of attachment apertures are formed through at least a portion of said front carrier; and a back carrier having a back attachment layer, wherein back shoulder strap extensions are formed integral to said back attachment layer, wherein said back shoulder strap extensions extend from a portion of said back attachment layer, wherein each of said back shoulder strap extensions includes a shoulder strap channel formed through at least a portion of said back shoulder strap extension such that at least a portion of one of said front shoulder strap extensions may be received within at least a portion of each respective shoulder strap channel, wherein each of said front shoulder strap extensions includes a front shoulder strap releasable hook and loop fastener element and wherein at least a portion of a back shoulder strap releasable hook and loop fastener element is attached or coupled within said shoulder strap channel to releasably interact with said front shoulder strap releasable hook and loop fastener element if one of said front shoulder strap extensions is appropriately positioned within said shoulder strap channel, such that, in an attached or coupled configuration, a terminating end of each of said front shoulder strap extensions is positioned to extend to said back carrier, wherein a plurality of attachment apertures are formed through at least a portion of said back carrier, and wherein each attachment aperture is defined by two equal length, parallel sides, an arcuate side joining respective upper terminal ends of said parallel sides, and an arcuate side joining respective lower terminal ends of said parallel sides.

* * * * *